US006882329B2

(12) United States Patent
Isono et al.

(10) Patent No.: US 6,882,329 B2
(45) Date of Patent: Apr. 19, 2005

(54) DRIVE SIGNAL GENERATOR AND IMAGE DISPLAY APPARATUS

(75) Inventors: Aoji Isono, Kanagawa (JP); Tadashi Aoki, Kanagawa (JP); Kazuhiko Murayama, Kanagawa (JP); Kenji Shino, Kanagawa (JP); Tsutomu Sakamoto, Saitama (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 329 days.

(21) Appl. No.: 10/255,720

(22) Filed: Sep. 27, 2002

(65) Prior Publication Data

US 2003/0063108 A1 Apr. 3, 2003

(30) Foreign Application Priority Data

Sep. 28, 2001 (JP) ..... 2001-300087
Sep. 28, 2001 (JP) ..... 2001-300088

(51) Int. Cl.[7] ..... G09G 3/28
(52) U.S. Cl. ..... 345/69.7; 345/204
(58) Field of Search ..... 345/69, 45, 47, 345/65, 73, 74, 75.2, 76; 313/310, 309, 336, 351, 495, 496

(56) References Cited

U.S. PATENT DOCUMENTS 5,847,933 A * 12/1998 Lostumo et al. ..... 361/752
6,294,876 B1 9/2001 Ando et al. ..... 315/169.1
6,404,135 B1 6/2002 Shino ..... 315/169.1
6,693,375 B1 * 2/2004 Maruyama ..... 313/495
2001/0019247 A1 * 9/2001 Tsukamoto ..... 315/169.3

FOREIGN PATENT DOCUMENTS

JP 407177446 A * 7/1995

* cited by examiner

*Primary Examiner*—Bipin Shalwala
*Assistant Examiner*—Nitin Patel
(74) *Attorney, Agent, or Firm*—Fitzpatrick, Cella, Harper & Scinto

(57) ABSTRACT

A drive signal generation circuit which performs gradation control on a load by a drive signal having a stepped waveform. In a case where the wave height value corresponding to input gradation data is Vm ($2 \leqq m \leqq n$), the drive signal is caused to rise in such a manner that each output Vk ($2 \leqq k \leqq m$) is produced one slot after the output V(k−1) to increase the wave height value V0 (reference potential) to Vm in a stepping manner. One slot corresponds to a unit time of the pulse width modulation. The drive signal is caused to fall in such a manner that each output V(k−1) ($1 \leqq k \leqq m-1$) is produced one or two slots after the output Vk to reduce the wave height value from Vm to off level in a stepping manner. A delay circuit is used to delay signals slot by slot. A selection is made from delayed signals according to luminance data to determine a waveform. The circuit is also designed to enable the drive signal waveform rise position to be changed.

26 Claims, 25 Drawing Sheets

DRIVE SIGNAL GENERATOR AND IMAGE DISPLAY APPARATUS

BACKGROUND OF THE INVENTION

1. Field of the Invention

The present invention relates to a drive signal generation circuit for driving loads such as light-emitting devices, including semiconductor devices and electron-emitting devices, according to gradation data, and to an image display apparatus using the drive signal generation circuit. More particularly, the present invention relates to a drive signal generation circuit suitable for simultaneously driving a plurality of loads such as light-emitting devices connected to wiring having inductance and capacitance components, and to an image display apparatus using the drive signal generation circuit.

2. Description of the Related Art

Heretofore, image display apparatus having an image display panel in which a plurality of light-emitting devices such as electron-emitting devices, light-emitting diodes (LED) or organic electroluminescent (EL) elements are connected by matrix wiring are known. Image display apparatus using such light-emitting devices are advantageous in that they require no backlight since they are of a self-light-emitting type, and that they have a wide viewing angle.

As methods of driving light-emitting devices connected by matrix wiring, methods using pulse width modulation (PWM), pulse-amplitude modulation (PAM), and a combination of pulse width modulation and pulse-amplitude modulation are known. Various circuits' arrangements for performing these kinds of modulation have also been provided.

With the increase in the number of gradations in displays using conventional drive methods using pulse width modulation or pulse-amplitude modulation, a need for operation at a higher speed has arisen with respect to the pulse width corresponding to the least significant bit (LSB), i.e., the minimum unit of data, or for higher output accuracy with respect to amplitude values. Therefore methods using a combination of pulse width modulation and pulse-amplitude modulation have come into use.

Matrix wiring connecting devices has, however, inductance components and capacitance components. If gradation control of devices connected to such wiring having inductance components and capacitance components is performed by a combination of pulse width modulation and pulse-amplitude modulation, ringing occurs in each of rises and falls of the signal waveform to cause a difference from the desired waveform according to data.

In a case where devices arranged in parallel with each other, for example, in correspondence with information signal electrodes in matrix wiring in an image display panel are driven by a plurality of drive signal generation circuits, if a certain number of the devices are driven simultaneously, the current flowing from each drive signal generation circuit to the devices is increased, and influences which a drop in the voltage of the output power supply and a voltage drop across a wiring resistance due to the difference in current value give to the signal for driving each device largely vary.

SUMMARY OF THE INVENTION

Problems which the present invention can solve are as follow; Realization of a drive signal generation circuit suitable for controlling the shape of a rising or falling portion or both rising and falling portions of the waveform of a drive signal, a drive signal generation circuit capable of preventing concentration of currents by dispersing currents with respect to time even in a case where a plurality of drive circuits similar to each other are provided, and an image display apparatus realizing suitable image display by using techniques relating to the drive signal generation circuit.

By considering the increase in the number of gradations and limitation of influence of ringing at the time of driving, the inventors of the present invention have used multistage power supply in combination with pulse width modulation to devise a method of driving devices by a waveform which rises and falls in a stepping manner as shown in FIG. 2. An example of this method will be described with respect to a case where a four-step potential source is used.

Referring to FIG. 2, V1 to V4 are in a relationship V1<V2<V3<V4, and one block defined by a time Δt for one slot and a potential difference V4−V3, V3−V2, V2−V1 or V1−V0 (V0: reference potential) represents a waveform for outputting a gradation corresponding to one LSB. For a first gradation, one block of level V1 is output. For second and third gradations, blocks of level V1 are successively added. For the next fourth gradation, a block of level V2 is stacked with one-slot delay from the block for the first gradation. For the fifth gradation, another block of level V1 is added. For the sixth gradation, another block of level V2 is stacked. Similar steps are repeated to stack blocks of levels V2, V3, and V4 after the level V1 block. After stacking of a block of level V4, stacking of blocks from level V1 to V4 is repeated. In this drive, if the number of bits in the direction of horizontal placement of blocks (time axis direction) is eight, the number of bits in the vertical direction (voltage direction) is two and an expression substantially in a total of ten bits as a whole can be made. The potential is increased from V1 to V2, from V2 to V3, and from V3 to V4 at the time of rising, and is reduced from V4 to V3, from V3 to V2, from V2 to V1, thus being changed step by step. In this manner, the change in current (dV/dt) that causes ringing is limited to reduce the influence of ringing.

According to the present invention, a drive circuit capable of generating a drive signal having a waveform shaped in a stepping manner in rising and falling portions, e.g., the above-described waveform can be realized in a simple configuration.

A drive signal generation circuit according to the present invention is constructed as follows:

a drive signal generation circuit which performs gradation control on a load by a drive signal having a stepped waveform, the drive signal being obtained by performing wave height-value modulation and pulse width modulation in combination using a multistage potential source (V(n−1) <Vn) having a potential range from V1 to Vn (n: an integer equal to or larger than 2), and in which if the wave height value corresponding to input gradation data is Vm (2≦m≦n; m: an integer), the drive signal is caused to rise in such a manner that each output Vk (2≦k≦m; k: an integer) is produced one slot after the output V(k−1) to increase the wave height value from off level to Vm in a stepping manner, one slot corresponding to a unit time of the pulse width modulation, and the drive signal is caused to fall in such a manner that each output V(k−1) (1≦k≦m−1) is produced one or two slots after the output Vk to reduce the wave height value from Vm to off level in a stepping manner, said drive signal generation circuit comprising:

a start pulse output circuit for generating a pulse with which a start of the output V1 is synchronized;

an end pulse output circuit which outputs a pulse with which an end of the output Vm is synchronized;

a first delay circuit which produces a plurality of delayed outputs by successively delaying one slot at a time the pulse with which the start of the output V1 is synchronized;

a second delay circuit which produces a plurality of delayed outputs by successively delaying in one-slot steps the pulse with which the end of the output Vm is synchronized;

a circuit which generates the pulse with which the start of the output V1 is synchronized, the pulse with which the end of the output Vm is synchronized, and a control signal for setting the pulse width of each output Vk ($1 \leqq k \leqq n$) from the delayed outputs; and a pulse width generation circuit which produces a pulse width signal of each output Vk ($1 \leqq k \leqq n$) by the control signal.

This circuit can be formed in a simple configuration to produce a drive signal having a stepped waveform. The off level may be such a level that the load is not substantially driven even when this level is applied to the load (the load is not driven for one gradation even when this level is set with the minimum pulse width for pulse width modulation). Wave height values V1 to Vn may be selected at such levels that the load in varying condition can be substantially driven by each of them. When the lowest wave height value V1 is set and is given the shortest pulse width for pulse width modulation, it is set to such a level that the load is substantially driven (set in a driving condition corresponding to one gradation data item). The load is driven by application of a voltage thereto. If the signal level (wave height value) of the waveform of the above-described drive signal is specified in terms of potential, the voltage applied to the load is given as a potential difference between a basic potential applied to the load (for example, corresponding to a selecting potential in the case of matrix drive as described below) and the potential of the drive signal. If the signal level (wave height value) of the waveform of the above-described drive signal is specified in terms of current value, the voltage across the load is given as a potential difference between the basic potential applied to the load and a potential given to set the signal level of the drive signal to a predetermined current value.

A plurality of said signal generation circuits are used by being combined in parallel with each other to respectively perform gradation control on loads connected in parallel with each other;

said start pulse output circuit selects one of a first timing in the first half of the pulse width control period, and a third timing preceding a second timing in the second half of the pulse width control period by at least a period of time corresponding to the pulse width of the output Vm to generate a pulse with which the start of the output V1 is synchronized; and said end pulse output circuit selects one of a fourth timing coming after the first timing with at least a period of time corresponding to the pulse width of the output Vm, and the second timing to generate a pulse with which the end of the output Vm is synchronized.

This drive signal generation circuit can be formed in a simple configuration to produce a drive signal having a stepped waveform. The start pulse output circuit is arranged to generate the pulse for synchronization of a start of output V1 by selecting one of the first timing and the third timing. Therefore, in a case where a plurality of circuits of this kind are used, they may be separated into a group in which the drive signal is generated on the basis of the first timing and another group in which the drive signal is generated on the basis of the third timing, thereby dispersing currents with respect to time to prevent concentration of currents.

The present invention includes a drive signal generation circuit as follows:

a drive signal generation circuit which generates a drive signal for gradation control on a light-emitting device, the drive signal having a waveform formed by selecting a signal level from a plurality of n wave height values corresponding to different light-emitting states, said drive signal generation circuit comprising:

a circuit A which outputs a raise signal with which a rise in the waveform of the drive signal is synchronized;

a circuit B which outputs at least (n−1) number of delayed signals with an incremental delay of a predetermined time period from the raise signal; and a circuit C which outputs the drive signal having a rising shape formed in the waveform of the drive signal in such a manner that the signal level is raised in synchronization with the raise signal from a signal level corresponding to an off state of the light-emitting device to the lowest of the n wave height values, and is thereafter increased to the higher wave height value one step at a time in synchronization with the delayed signals with the delay of the predetermined time period until a predetermined wave height value determined by input gradation data is reached.

This arrangement makes it possible to set stepped rises in the drive signal waveform. In particular, since the delay circuit is used, it is not necessary to separately control timing for the rise of each wave height value to the next-stage wave height value. According to the signal level of each portion of the drive signal, the corresponding light-emitting state is determined. The light-emitting states thus determined are visually integrated on the time axis to obtain luminance with respect to luminance data. An arrangement for delaying a signal by the predetermined time period to obtain each of the above-described delayed signals is preferably used.

In particular a preferable arrangement to be adopted is as follows:

a drive signal generation circuit comprising;

a circuit D that outputs a fall-causing signal with which a fall of the drive signal waveform from the predetermined wave height value is synchronized; and a circuit E which outputs at least n number of delayed fall signals with an incremental delay of a predetermined time period from the fall-causing signal, wherein the circuit C causes the signal level to fall to the wave height value one step lower than the predetermined wave height value in synchronization with the fall-causing signal, and thereafter causes the signal level to fall to the lower wave height values one step at a time in synchronization with the delayed fall-causing signals selected according to the input gradation data.

This arrangement eliminates the need to determine the fall timing from each wave height value to the next-stage wave height value by separately measuring maintenance time by counting. After the signal level has been increased to the predetermined wave height value, this wave height value may be maintained before the fall from this wave height value is made at the above-described fall point. This is advantageous in terms of ease of control. An arrangement for delaying a signal by the predetermined time period to obtain each of the above-described delayed fall signals is preferably used.

A preferable arrangement to be adopted is as follows:

a drive signal generation circuit, wherein said circuit A outputs the raise signal by a timing based on a trigger signal and raise position data externally supplied.

Also, since the timing of rising of the drive signal waveform can be changed by using rise position data, the arrangement using a plurality of circuits of the same kind may be such that the timings of rising of the drive signal waveforms in the circuits are suitably shifted from each other to disperse currents with respect to time, thus preventing concentration of currents.

In a preferred embodiment of the present invention, the above-described rise position data is constituted by a rise sync/fall sync change signal for selecting timing of one of rising and falling of the drive signal waveforms for synchronization between a plurality of drive signal generation circuits, and data designating the amount of delay of the timing of rising of the drive signal waveform in the case of fall synchronization from the timing of rising of the drive signal waveform in the case of rise synchronization. When the above-described trigger signal is input in the case of rise synchronization, the rise signal is immediately output from the above-described circuit A.

The present invention includes a drive signal generation circuit which generates a drive signal for gradation control on a light-emitting device, the drive signal having a waveform formed by selecting a signal level from a plurality of n wave height values corresponding to different light-emitting states, said drive signal generation circuit comprising:

a circuit D which outputs a tall-causing signal with which a fall in signal level from a predetermined wave height value to a wave height value one step lower is synchronized;

a circuit E which outputs at least n number of delayed fall-causing signals with an incremental delay of a predetermined time period from the fall-causing signal; and a circuit C which causes the signal level to fall to the wave height value one step lower than the predetermined wave height value in synchronization with the fall-causing signal, and thereafter causes the signal level to fall to the lower wave height values one step at a time in synchronization with the delayed fall-causing signals selected according to the input gradation data.

This arrangement makes it possible to set stepped falls in the drive signal waveform. In particular, since the delay circuit is used, it is not necessary to determine the fall timing of each wave height value to the next-stage wave height value by counting separately.

In each of the above-described aspects of the present invention, the delayed signals with an incremental delay of a predetermined time period from the rise signal or the delayed signals with an incremental delay of a predetermined time period from the fall signal can easily obtained on the basis of the rise signal or the fall signal.

The selection of the above-described delayed fall signals may be such that if the predetermined wave height value is the mth from the lowest of the n number of wave height values ($m \leqq n$), the (m−1) number in the n number of delayed fall signals may be selected. The (m−1) number of delayed fall signals may be selected from the above-described n number of delayed fall signals (in particular, the (m−1) number in the leading m delayed signals in the n number of delayed fall signals may be selected) to form the drive signal in such a waveform that each of the wave height values lower than the predetermined (maximum) wave height value is output during the predetermined time period, or one of the wave height values lower than the predetermined (maximum) wave height value is output during the period twice as long as the predetermined time period while each of the other wave height values is output during the predetermined time period. More specifically, the selection of the above-described delayed fall signals may be such that all the consecutive delayed fall signals (with a delay of a predetermined period repeatedly incremented from the fall signal) corresponding in number to all the wave height values lower than the predetermined wave height values are selected or the delayed signals except one in these consecutive delayed signals and another delayed signal following them are selected (one to be removed among these consecutive delayed signals and the following one delayed signal is selected). This selection is made on the basis of gradation data. If the above-described selection is made, waveforms can be formed for all the possible gradations.

For example, if the wave height values to which the signal level can be set are V1, V2, V3, and V4 (V1<V2<V3<V4), and if gradation data requiring setting the signal level to V4 is given, the signal level is caused to fall from V4 to V3 on the basis of the tall signal and is then caused to fall from V3 to V2, from V2 to V1, and from V1 to the level corresponding to the non-light-emitting condition. If three delayed signals incrementally delayed from the fall signal by a predetermined time are selected, and if falls are caused at the corresponding stages on the basis of the delayed signals, signal levels of V3, V2, and V1 are each maintained for the predetermined time period, followed by a fall. If the three delayed signals except the first delayed signal are selected from the four delayed signals incrementally delayed from the fall signal by a predetermined time, and if falls are caused at the corresponding stages on the basis of these delayed signals, the signal level V3 is maintained for the period twice the predetermined time period, while each of the signal levels V2 and V1 is maintained for the predetermined time period. If the three delayed signals except the second delayed signal are selected from the four delayed signals incrementally delayed from the fall signal by a predetermined time, and if falls are caused at the corresponding stages on the basis of these delayed signals, the signal level V3 is maintained for the predetermined time period, the signal level V2 is for the period twice the predetermined time period, and the signal level V1 is maintained for the predetermined time period. If the three delayed signals except the third delayed signal are selected from the four delayed signals incrementally delayed from the fall signal by a predetermined time, and if falls are caused at the corresponding stages on the basis of these delayed signals, each of the signal levels V3 and V2 is maintained for the predetermined time period, and the signal level V1 is for the period twice the predetermined time period. As the shape of the falling portion of the signal waveform, one of the above-described stepped shapes is selected, thus realizing waveforms for all the gradations.

A preferable arrangement to be adopted is as follows:

a drive signal generation circuit, wherein said circuit D outputs the fall-causing signal by a timing based on a trigger signal and fall-causing position data externally supplied.

This arrangement makes it possible to set stepped falls in the drive signal waveform. In particular, since the delay circuit is used, it is not necessary to determine the fall timing of each wave height value to the next-stage wave height value by counting separately.

In a preferred embodiment of the present invention, the above-described fall position data is constituted by the above-described rise sync/fall sync change signal and limit position setting data set to prevent the generated drive signal from exceeding a predetermined pulse width control limit. The fall position in the case of rise synchronization is determined by input gradation data.

Heretofore, a light-emitting devices indicates light-emitting diode (LED) or organic electroluminescent (EL) element and the like A light-emitting devices also includes electron-emitting devices functioning as a light-emitting device in combination to a luminescent member such as a phosphor which emits light with the energy given by the device. The present invention is effectively applied to an arrangement using devices through which currents flow with the drive.

The invention includes an arrangement as follows:

an image display apparatus comprising:

a plurality of scanning wirings and a plurality of modulation wirings connected in a matrix configuration;

light-emitting devices provided in correspondence with points of intersection of said scanning wirings and said modulation wirings; and a drive signal generation circuit which generates a drive signal for performing gradation control on each of said light-emitting devices according in an input luminance signal, wherein the drive signal is obtained by modulation which is a combination of wave height-value modulation and pulse width modulation, and has a waveform in which the wave height value is successively increased in a stepping manner from a rise start point determined by a gradation value in a luminance signal related to the drive signal, and is successively reduced in a stepping manner from a fall start point determined irrespective of the gradation value.

In this arrangement, the fall start point may be fixedly set at a predetermined time period before the end point of the predetermined time within which the waveform is to be confined, since the time period during which the wave height value is reduced in a stepping manner is required after the fall start point.

The present invention also includes an arrangement as follows:

an image display apparatus comprising:

a plurality of scanning wirings and a plurality of modulation wirings connected in a matrix configuration;

light-emitting devices provided in correspondence with points of intersection of said scanning wirings and said modulation wirings; and a drive signal generation circuit which generates a drive signal for performing gradation control on each of said light-emitting devices according to an input luminance signal, wherein the drive signal is obtained by modulation which is a combination of wave height-value modulation and pulse width modulation, and wherein, in a time period during which one of said plurality of scanning wirings is selected, each of part of the plurality of drive signals for gradation control on the plurality of light-emitting devices connected to the selected one of the scanning wirings has a waveform in which the wave height value is successively increased in a stepping manner from a rise start point determined by a gradation value in a luminance signal related to the drive signal, and is successively reduced in a stepping manner from a fall start point determined irrespective of the gradation value, and each of the other drive signals has a waveform in which the wave height value is successively reduced from a fall start point determined by a gradation value in a luminance signal related to the drive signal, and is, before the start of falling, successively increased in a stepping manner from a rise start point determined irrespective of the gradation value.

In this arrangement, currents caused to flow during one scanning period can be advantageously dispersed.

DETAILED DESCRIPTION OF THE PREFERRED EMBODIMENTS (First Embodiment)

A first preferred embodiment of a drive signal generator according to the present invention is described below by using symbols shown in FIG. 1. The drive signal generation circuit comprises:

synchronization clock signal CLK for setting the time width of a slot;

start trigger signal TRG for setting a start of a drive signal; and control data including first data signal PHM1 . . 0 for setting an amplitude Vm of the drive signal, second data signal Data9 . . 2 for setting the width of a pulse having the amplitude Vm, and third data signal Data1 . . 0 for setting the stepped shape of a falling portion (these control data items are prepared on the basis of the input gradation data);

at least a start pulse circuit 1 (circuit A), an end pulse generation circuit 2 (circuit D) and a delay circuit 3 (a first delay circuit (circuit B), a second delay circuit (circuit E)) are controlled by synchronization clock signal CLK;

the start pulse signal generation circuit 1 is controlled by start trigger signal TRG;

the end pulse generation circuit 2 is controlled by start trigger signal TRG and second data signal Data9 . . 2; and the decoding circuit 4 (a portion of the circuit C, the circuit for generating the control signal) is controlled by third data signal Data1 . . 0 and first data signal PHM1 . . 0.

More specifically, the start pulse generation circuit 1 generates a start pulse START in synchronization with synchronization clock signal CLK on the basis of start trigger signal TRG.

Figure 3:
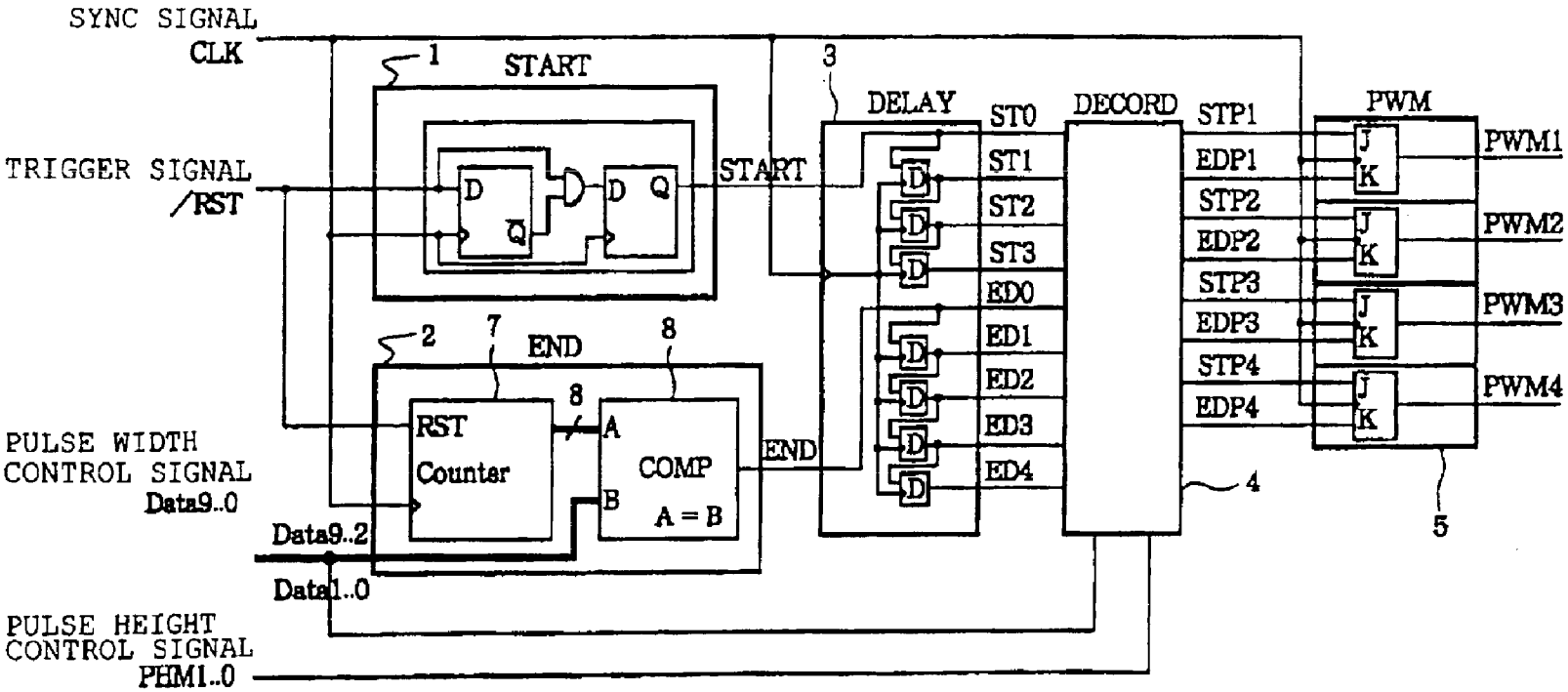
FIG. 3 is a circuit diagram showing an example of details of the circuit shown in FIG. 1.

The end pulse generation circuit 2 has a counter 7 and a comparator 8 shown in FIG. 3. The counter 7 is reset by start trigger signal TRG (shown as reset signal/RST in FIG. 3), counts synchronization clock signal CLK. The comparator 8 generates an end pulse END when the count value of the counter 7 and second data signal Data9 . . 2 coincide with each other.

The delay circuit 3 outputs start pulse START without a delay (ST0) and outputs (n−1) number of delayed outputs ST1, ST2, and ST3 by delaying start pulse START by (j−1) slots with respect to each j in $2 \leqq j \leqq n$. Further, the delay circuit 3 outputs end pulse END without a delay (ED0) and outputs delayed outputs ED1, ED2, ED3, and ED4 by delaying end pulse END by j slots with respect to each j in $1 \leqq j \leqq n$.

In an embodiment described below, the start pulse output from the start pulse generation circuit is output from the delay circuit without a delay, and the first rise (output V1) of the drive signal waveform is synchronized with this start pulse. That is, the start pulse generation circuit is formed as a start pulse output circuit. Similarly, the end pulse generation circuit is also formed as an end pulse output circuit. ST0 and ED0 may be directly output from the start pulse generation circuit and the end pulse generation circuit to the decoding circuit 4 without being passed through the delay circuit 3.

In the embodiment described below, the start pulse output from the start pulse generation circuit is used as start signal ST0 with which the rise of V1 which is the lowest wave height value is synchronized. However, a pulse obtained by delaying the start pulse output from the start pulse generation circuit by $\alpha$ slots ($\alpha \geqq 0$) may alternatively be used as ST0. When this pulse is used, delayed outputs ST1, ST2, and ST3 are obtained by successively being delayed from ST0 in one-slot steps. Also, while the end pulse output from the end pulse generation circuit is used as signal ED0 with which the fall of the signal level from the maximum wave height value determined by luminance data is synchronized, a pulse obtained by delaying the end pulse output from the end pulse generation circuit by $\alpha$ slots ($\alpha > 0$) may alternatively be used as ED0. When this pulse is used, delayed outputs ED1, ED2, ED3, and ED4 are obtained by successively being delayed from ED0 in one-slot steps.

The circuit C for outputting a drive signal having a predetermined waveform, is composed of the decoding circuit 4, a pulse width generation circuit 5 and an output circuit 6. The decoding circuit 4 selects, as output start pulse STPk of each amplitude output Vk, one of ST0 corresponding to start pulse and (n−1) number of delayed outputs ST1 to ST3 with delays from ST0 on the basis of first data signal PHM1 . . 0 and third data signal Data1 . . 0. ST0 to ST3 respectively correspond to STP1 to STP4. The decoding circuit 4 also selects, as output end pulse EDPk for each amplitude output Vk, one of ED0 corresponding to the end pulse and n number of delayed outputs ED1 to ED4 with delays from ED0. ED0 corresponds to EDP4. Also, ED1, ED2, and ED3 respectively correspond to EDP3, EDP2, and EDP1, or three of ED1 to ED4 correspond in their consecutive order to EDP3 to EDP1.

The pulse width generation circuit 5 outputs, as pulse width signals PWMk for output Vk, signals each turned on by being timed to start pulse STPk of the corresponding output Vk and turned off by being timed to output end pulse EDPk of the output Vk.

This embodiment is also characterized by having the output circuit 6 which outputs each of the wave height values on the basis of pulse width signals PWM1 to PWM4, and which outputs only the highest wave height value in a case where on signals have occurred simultaneously with respect to two or more outputs Vk.

An electron-emitting device is adopted as a load. Light is produced by irradiating a phosphor with electrons emitted by applying the above-described drive signal to the electron-emitting device. A surface conduction type of emitting device, in particular, is adopted as the electron-emitting device. In an arrangement of an image display apparatus, surface-conduction emitting devices are used as electron-emitting devices which are connected in matrix form by a plurality of scanning wirings and a plurality of modulation wirings. In this arrangement, scanning drive is performed through the plurality of scanning wirings and a selecting potential is applied to a selected one of the scanning wirings. A plurality of the above-described drive signal generation circuits are respectively connected to the modulation wirings, and a drive signal is supplied from each drive signal generation circuit to each modulating wiring line as a signal for driving one of a plurality of loads (devices: electron-emitting devices in this embodiment) connected to the selected scanning wirings. As a signal level to be selected in the drive signal, a selection is made among certain number n of potentials (n=4 in embodiments described below). Each potential has a potential difference from the above-described selecting potential which is large enough to turn on the load, i.e., to make the electron-emitting device emit electrons sufficient for causing the phosphor to emit light. In this embodiment, a potential is applied as a non-selecting potential to the unselected scanning wirings such that even when the highest of the above-mentioned n potentials is applied from the modulation wirings to the electron-emitting devices connected to the unselected scanning lines, these electron-emitting devices do not have a degree of electron emission high enough to cause the phosphor to emit light.

With respect to the magnitude (height) of signal level of the waveform of the drive signal in this specification, a signal level higher than that of a certain state is a level enabling application of larger energy to the load (light-emitting device). For instance, in a case where a potential lower than the selecting potential is applied as the potential of the signal level of the drive signal, and where energy is applied to the load according to the potential difference therebetween, a signal level higher than a certain reference corresponds to a state of the potential of the signal level being lower than a certain reference.

As the signal level, either of selection among potential values and selection among current values may be made. If selection is made among current values, a plurality of current sources are provided in place of the plurality of potential sources in the output circuit 6. The time period during which each current source causes a predetermined current to flow (including a case where current is drawn in) may be controlled in accordance with the present invention and the sum of the currents caused by the current sources may be supplied to the load.

According to the present invention, a circuit which generates a drive signal having a waveform rising and/or falling in a stepping manner such that the change in current (=dV/dt) that causes ringing at the time of rising and/or falling of the drive signal is reduced to limit ringing, can be easily obtained at a low cost. The drive signal generation circuit of the present invention can be applied to drive of any kind of load even if the load is connected to wiring having inductance and capacitance components. The drive signal generation circuit of the present invention can be used particularly effectively in driving light-emitting devices using electron-emitting devices or light-emitting devices through which a current flows at the time of driving, e.g., LEDs or EL elements.

FIRST EXAMPLE

An example of the first embodiment of the present invention will be described. FIG. 1 shows a drive signal generation circuit according to the first embodiment of the present invention. This circuit is used to drive each of electron-emitting elements arranged at points of intersection of a plurality of column-direction (modulation) wiring lines and a plurality of row-direction (scanning) wiring lines in a matrix display. FIG. 1 shows a start pulse generation circuit 1, an end pulse generation circuit 2, a delay circuit 3, a decoding circuit 4, a pulse width generation circuit 5, and an output circuit 6. This arrangement enables gradation waveforms (drive signal waveforms) to be formed by using both pulse width modulation (PWM) and pulse amplitude modulation (PAM) as shown in FIG. 2. In FIG. 2, each of hatched portions represents an increase in luminance as one gradation step. The circuit in which four amplitude levels (wave height values) are realized here by using V1 to V4 potential selecting drive, and which outputs gradations corresponding to 10 bits as a total number of gradations will be described. The reference potential used as a basis for the signal level of the waveform of the drive signal may be determined according to the potential applied to the scanning wirings at such a level that unnecessary emission of light can be suppressed. In this example, the reference potential is set to ground potential.

Figure 1:
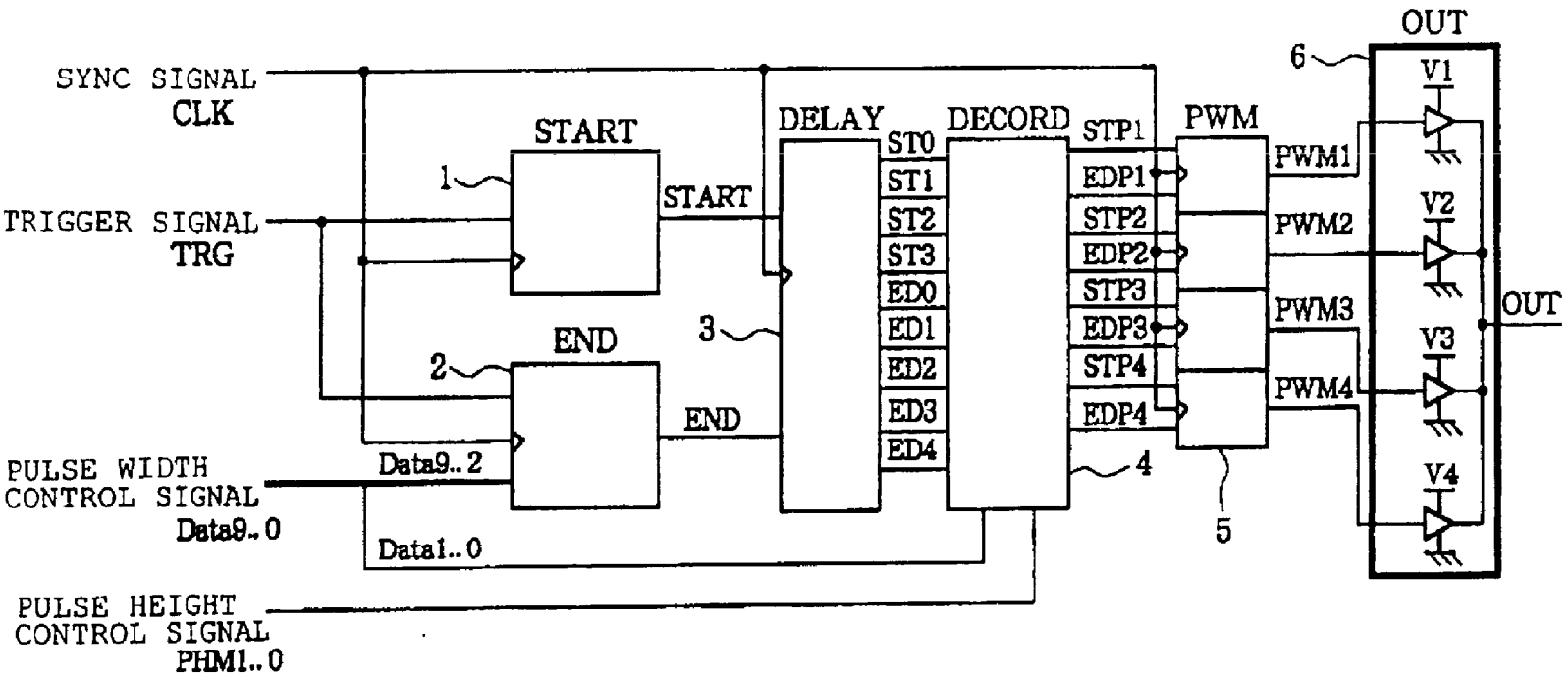
FIG. 1 is a block diagram showing the configuration of a drive signal generation circuit in a first embodiment of the present invention.
Figure 2:
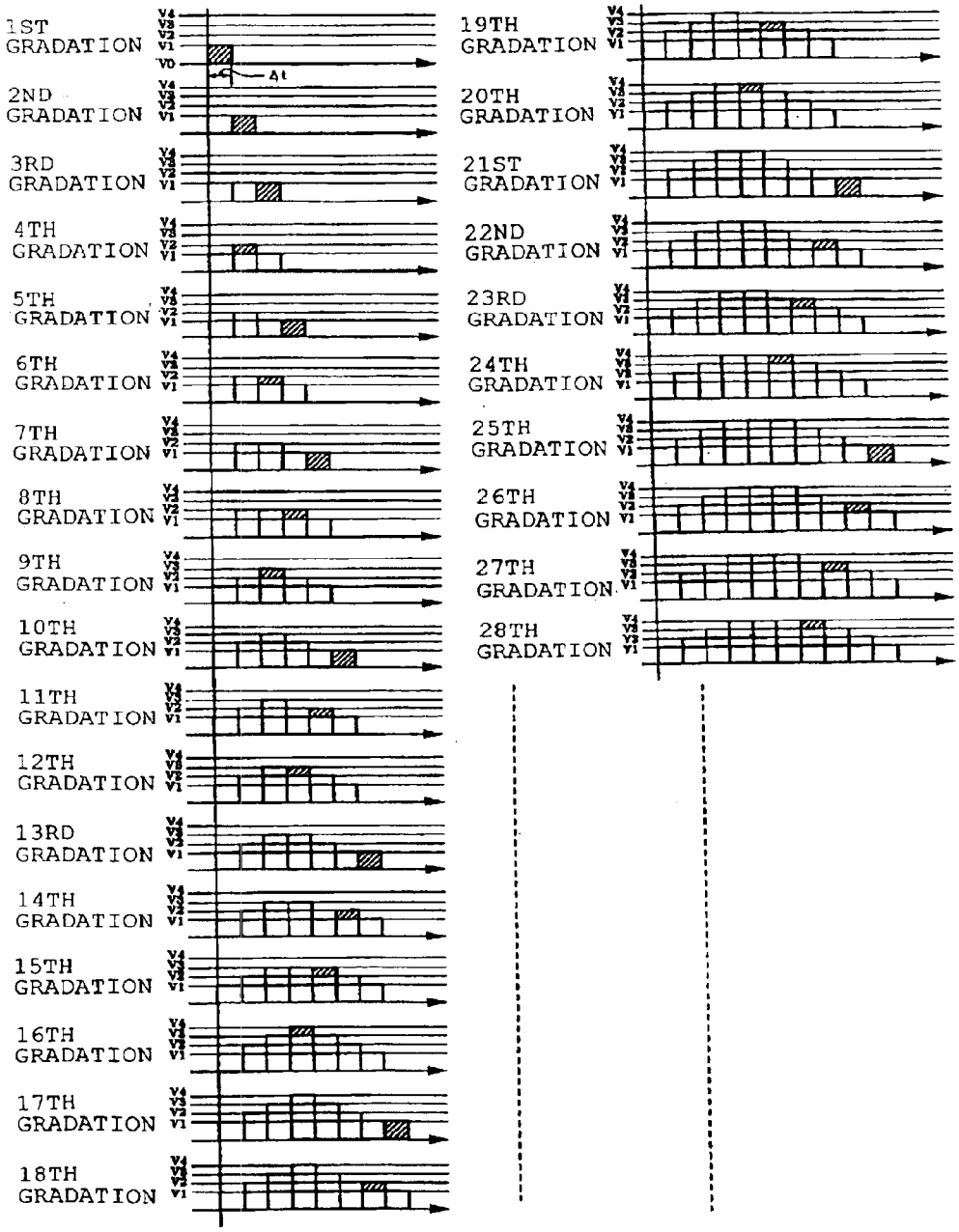
FIG. 2 is a waveform diagram showing a drive signal waveform in the case of rise synchronization which is an example of a drive signal waveform to be realized by the present invention.

Referring to FIG. 1, to enable the gradation waveforms shown in FIG. 2 to be formed, synchronization signal CLK for synchronization between timings of the circuits therein is input to the start pulse generation circuit 1, the end pulse generation circuit 2, the delay circuit 3, and the PWM generation circuit 5. Synchronization signal CLK may be input to the decoding circuit 4 in some case. Trigger signal TRG is input to the start pulse generation circuit 1 and the end pulse generation circuit 2 as a timing signal.

Pulse-width control signal Data9 . . 0 is a 10-bit control signal (data) for controlling the time width of the drive signal waveform. Pulse-height control signal PHM1 . . 0 is a 2-bit control signal (data) for controlling the amplitude (signal level of the drive signal) of the drive signal waveform. Pulse-height control signal PHM1 . . 0 indicates which one of the first to fourth levels, i.e., the wave height values V1 to V4 the maximum wave height value (Vm) of the drive signal waveform corresponds to. The upper eight bits of pulse width control signal Data9 . . 0 indicate the position at which the drive signal waveform falls (end pulse generation timing) in terms of the number of slots (0 to 255) from the predetermined rise position (start pulse generation timing). The lower two bits of pulse width control signal Data9 . . 0 indicate none or one of the first to third levels for which a delay slot width of 2 is set (the wave height value maintained for the time period corresponding to two slots in the stepped shape of the falling portion) as an expression of the stepped shape of the falling portion of the waveform. These control signals are prepared by a display controller (not shown) such as a microprocessor or a graphic controller on the basis of the above-mentioned gradation data corresponding to ten bits, and are input to this drive signal generation circuit.

The upper eight bits (Data9 . . 2) in the pulse width control signal Data9 . . 0 are input to the end pulse generation circuit 2, while the lower two bits (Data1 . . 0) and pulse height control signal PHM1 . . 0 are input to the decoding circuit 4.

In this example, to express gradation data of a data bit length R=10, pulse width control of unit pulses of a slot width of Δt in the range from 0 to 259 unit pulses is performed by using P=10 bits (Data 9 . . 0) and amplitude (wave height value) control in the range from 1 to 4 levels, i.e., wave height values V1 to V4, is performed by using Q=2 bits (PHM1 . . 0)(in actuality, Q=2 bits influences pulse width control). That is, the above-described data items R, P, and Q for representation of 10-bit image data are in a relationship R<P+Q.

In a case where R=P+Q, and where, for example, the upper two bits are used for amplitude control while pulse width control is performed by using the other eight bits, image data expression using all the ten bits cannot be made if the falling portion of the drive signal wave form is stepped. That is, the number of gradations is reduced. In this example, however, pulse width control is performed by using P=10 bits, so that R<P+Q, thus enabling the entire gradation data having R=10 bits to be expressed.

Digital signal processing in accordance with the present invention will be outlined below.

From 10-bit gradation data, a 12-bit digital video word is formed which includes a pulse width subword indicating the pulse width of the waveform and a wave height subword indicating wave height values to be used among the above-described plurality of wave height values (this subword containing no pulse width information).

The 12-bit digital video word is divided into the plurality of subwords: 10-bit pulse width subword and 2-bit wave height subword each input to the drive signal generation circuit.

In the drive signal generation circuit, each subword is converted into pulse width control signals PWM1 to PWM4 each having an active time corresponding to the pulse width of the drive signal waveform. The output circuit 6 is supplied with pulse width control signals PWM1 to PWM4 and outputs the drive signal applied to the light emitting devices.

In this example, the pulse width subword indicating the pulse width of the waveform is constituted by a subword (Data9 . . 2) corresponding to the period during which a predetermined wave height value in the waveform of the drive signal is output, and a subword (Data 1 . . 0) indicating the shape of the terminal end of the waveform of the drive signal.

From START signal and END signal respectively generated in the start pulse generation circuit 1 and the end pulse generation circuit 2, the delay circuit 3 forms a plurality of signals ST0 to ST3 and ED0 to ED4 with delays of 0 to a certain number of steps. Signals STP1 to STP4 and EDP1 to EDP4 obtained by decoding these signals ST0 to ST3 and ED0 to ED4 on the basis of the lower bits (Data1 . . 0) of the pulse width control signal and pulse height control signal PHM1 . . 0 are used to output from the PWM generation circuit 5 pulse width signals (PWM1 to PWM4) corresponding to V1 to V4. FIG. 3 shows an example of a circuit for generating the above-described signals.

Referring to FIG. 3, the start pulse generation circuit 1 is constituted by a D flip flop (delayed flip flop; a flip flop is also referred to as FF in this specification) and an AND gate; the end pulse generation circuit 2 is constituted by an 8-bit counter and an 8-bit comparator; the delay circuit 3 is constituted by three D-FFs forming a first delay circuit (respectively outputting ST1, ST2, and ST3) and four D-FFs forming a second delay circuit (respectively outputting ED1, ED2, ED3, and DE4); the decoding circuit 4 is constituted by gate circuits; and the PWM generation circuit 5 is constituted by JK-FFs.

In this example, the delay circuit 3 and the decoding circuit 4 which selects delayed outputs according to luminance data are arranged to enable the end pulse generation circuit 2 provided in a simple configuration using one set of a counter and a comparator to form a signal for controlling the pulse widths for outputting four potential levels from the pulse width generation circuit 5. Referring to FIG. 3, the trigger signal is input as the reset signal (/RST) to the D-FF in the start pulse circuit 1 and to the counter 7 in the end pulse generation circuit 2. The slash added as a symbol for the reset signal indicates that the reset signal is a negative-logic signal, that is, the reset signal is normally high level and resets the D-FF and the counter 7 when it becomes low level.

Referring to FIG. 3, synchronization signal CLK for synchronization of timing between the circuits is input to the start pulse generation circuit 1, the end pulse generation circuit 2, the delay circuit 3, and the PWM generation circuit 5. Synchronization signal CLK is also input to the decoding circuit 4 if necessary. Trigger signal /RST is input as a timing signal to the start pulse generation circuit 1 and the end pulse generation circuit 2. Pulse width control signal Data9 . . 0 is a control signal (data) for controlling the time width (pulse width) of the drive signal waveform, and pulse height control signal PHM1 . . 0 is a control signal (data) for controlling the amplitude (wave height value). The upper eight bits (Data9 . . 2) of pulse width control signal Data9 . . 0 are input to the end pulse generation circuit 2, while the lower two bits (Data1 . . 0) and pulse height control signal PHM1 . . 0 are input to the decoding circuit 4.

Figure 4:
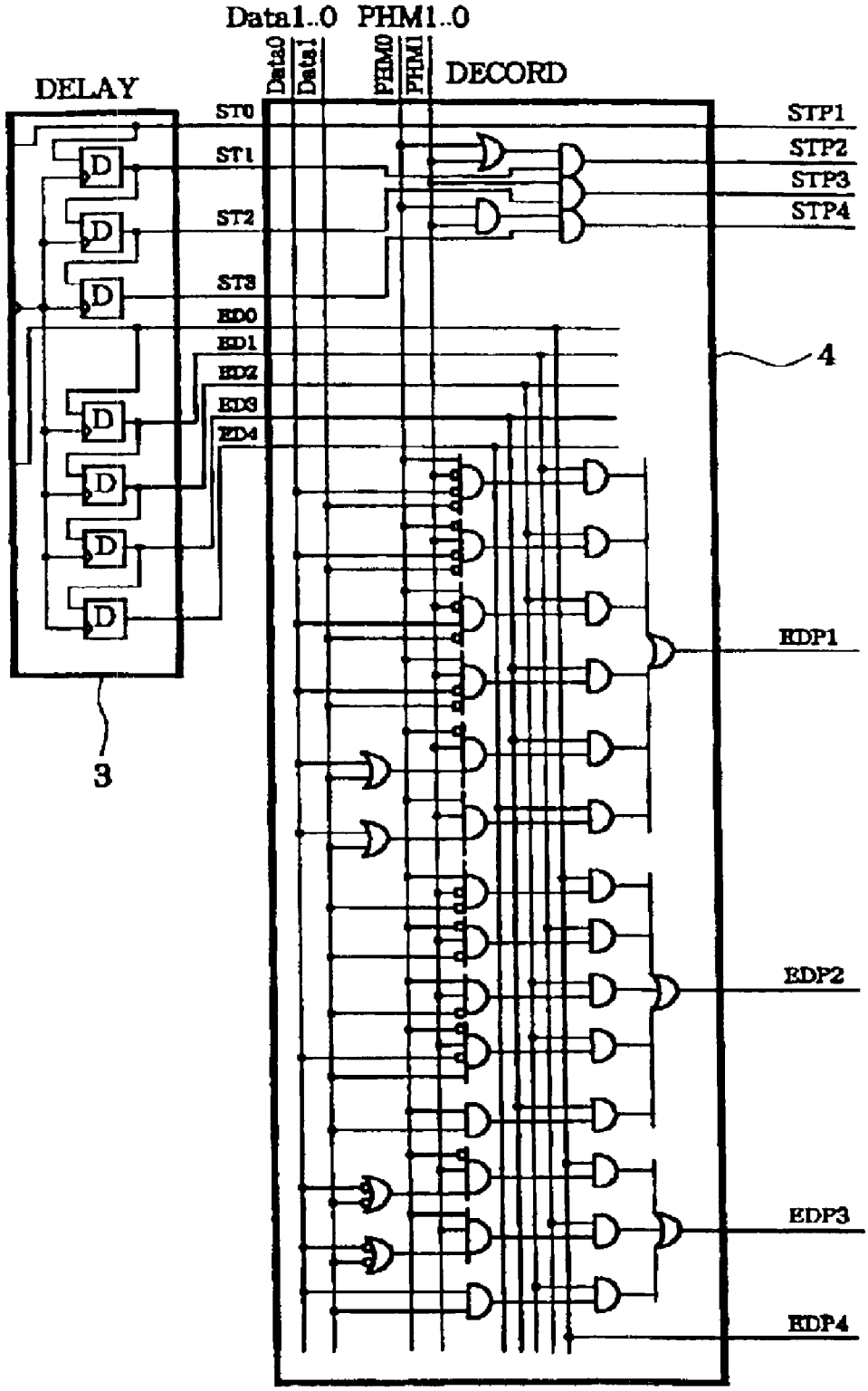
FIG. 4 is a circuit diagram showing an example of decoding circuit shown in FIG. 3.

START signal and END signal respectively generated in the start pulse generation circuit 1 and the end pulse generation circuit 2 are delayed 0 to a certain number of steps by the delay circuit 3 to form a plurality of signals ST0 to ST3 and ED0 to ED4. These delayed signals ST0 to ST3 and ED0 to ED4 are decoded into signals STP1 to STP4 and EDP1 to EDP4 by using control signals of Data1 . . 0 and wave height data PHM1 . . 0. From these signals STP1 to STP4 and EDP1 to EDP4, the PWM generation circuit 5 outputs pulse width signals (PWM1 to PWM4) corresponding to V1 to V4. FIG. 4 shows the configuration of the decoding circuit 4 of FIG. 3.

Figure 5:
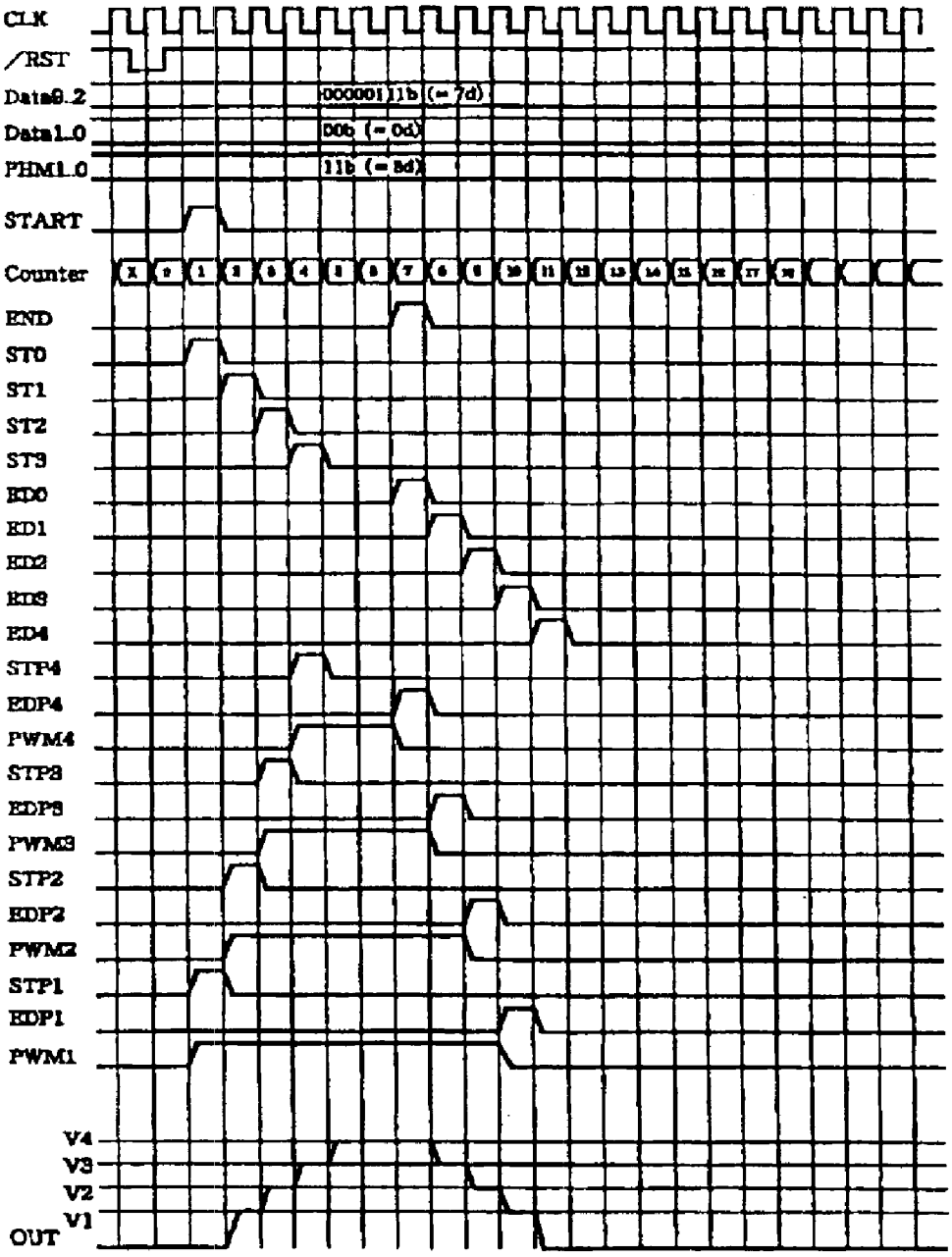
FIG. 5 is a timing chart for explaining the operation of the circuit shown in FIG. 3.
Figure 6:
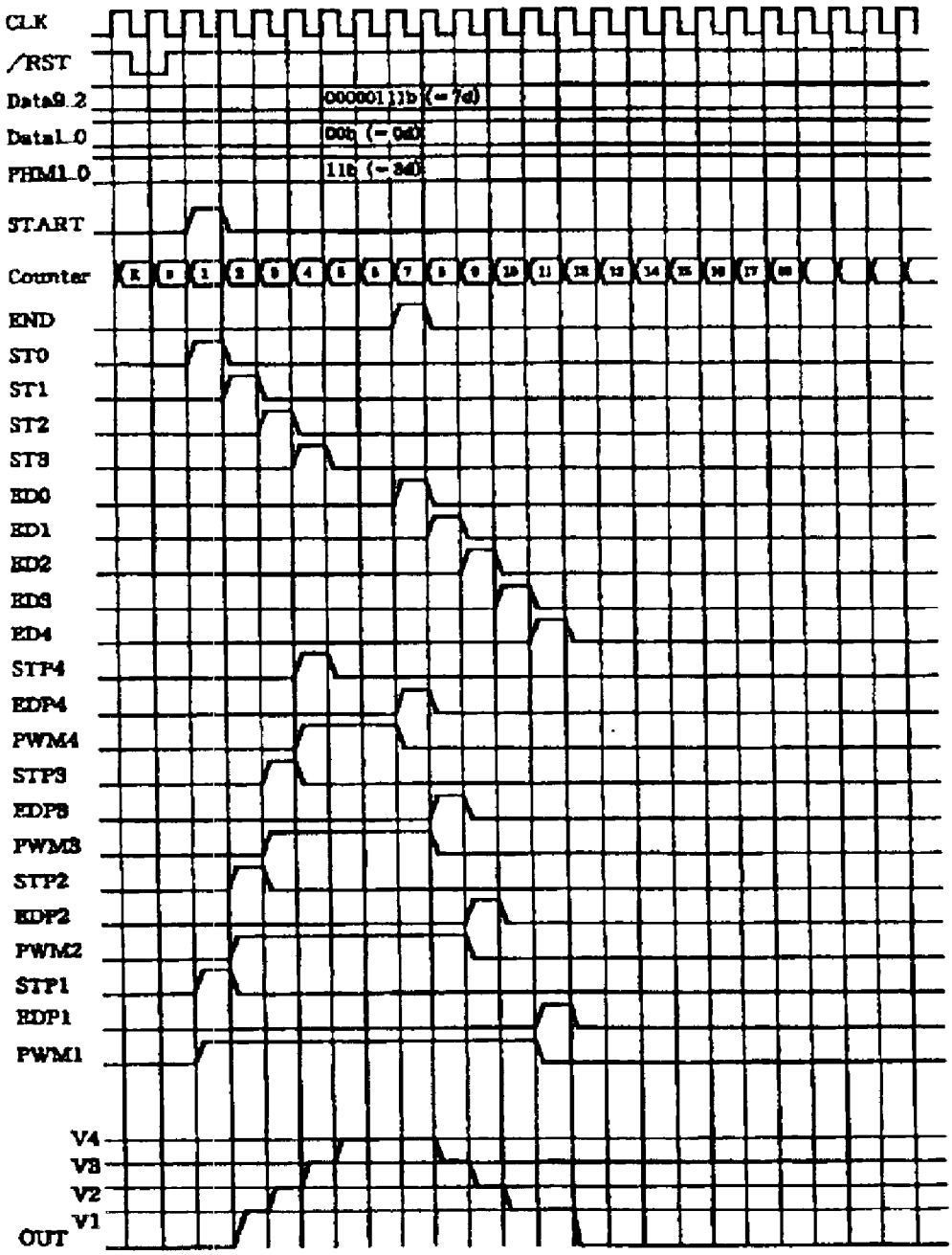
FIG. 6 is a timing chart for explaining the operation of the circuit shown in FIG. 3.
Figure 7:
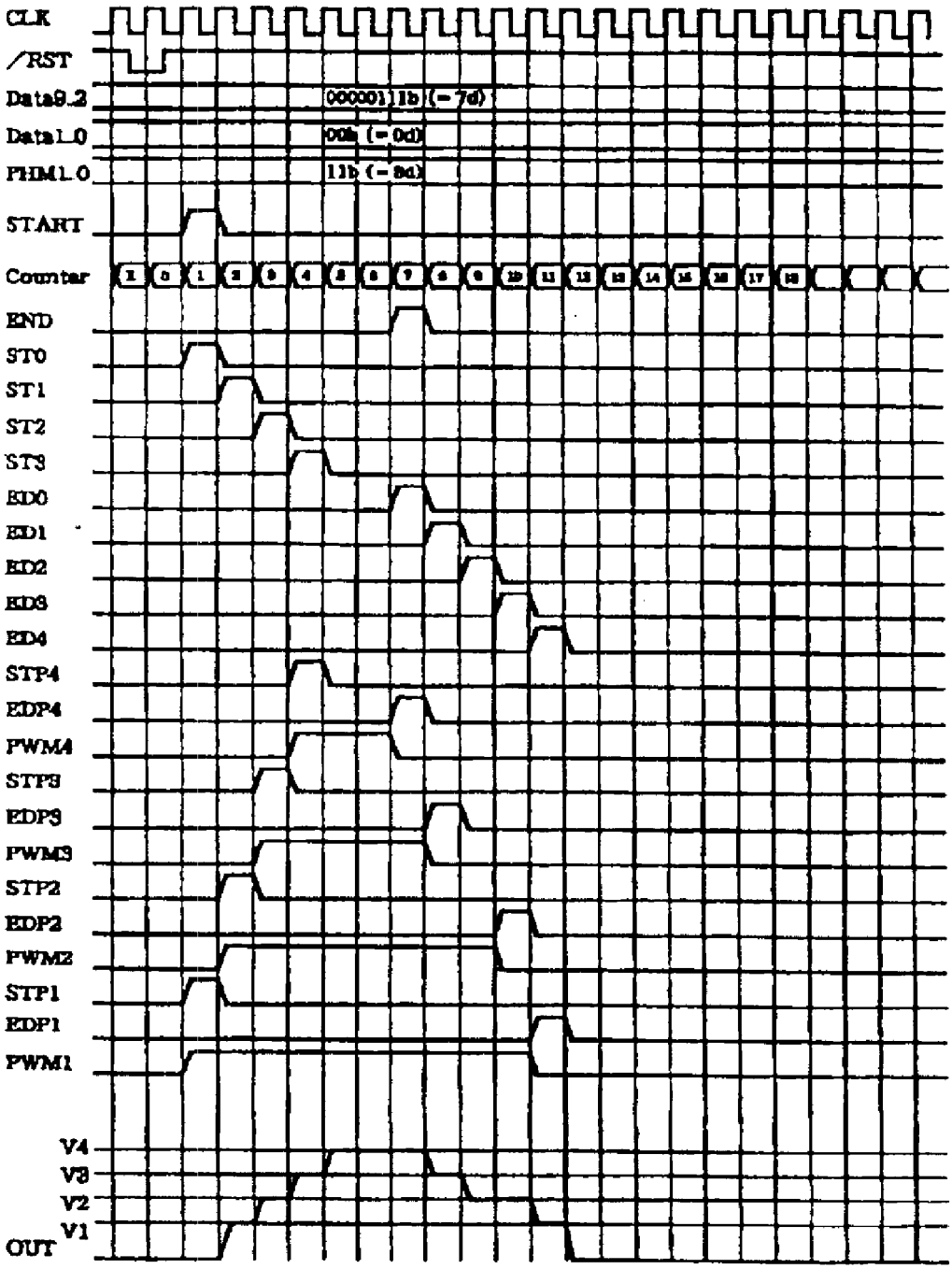
FIG. 7 is a timing chart for explaining the operation of the circuit shown in FIG. 3.
Figure 8:
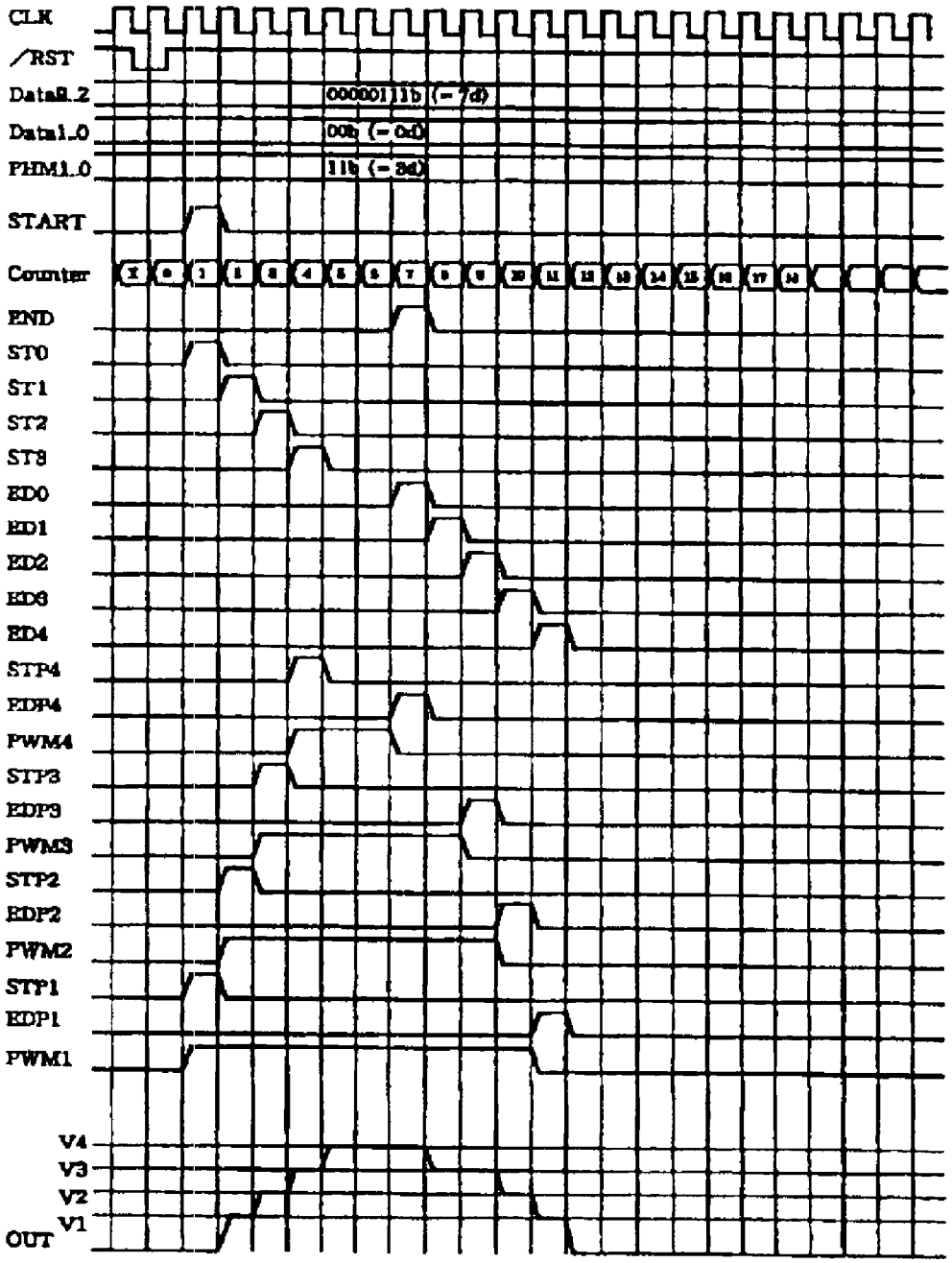
FIG. 8 is a timing chart for explaining the operation of the circuit shown in FIG. 3.

The functions of the circuits shown in FIG. 3 will be described with reference to timing charts shown in FIGS. 5 to 8. FIG. 5 is a timing chart when Data9 . . 0=0000011100b, FIG. 6 is a timing chart when Data9 . . 0=0000011101b, FIG. 7 is a timing chart when Data9 . . 0=0000011110b, and FIG. 8 is a timing chart when Data9 . . 0=0000011111b. PHM1 . . 0 signal is a control signal for controlling the drive voltage used (the wave height value of the signal level). If only V1 is used for the drive signal waveform, PHM1 . . 0=00b is input. If V1 and V2 are used for the drive signal waveform, PHM1 . . 0=01b is input. If V1 to V3 are used for the drive signal waveform, PHM1 . . 0=10b is input. If V1 to V4 are used for the drive signal waveform, PHM1 . . 0=11b is input. FIGS. 5 to 8 relate to the case where all potentials V1 to V4 are used for the drive signal waveform, and 11b is input as PHM1 . . 0.

The function of the circuits shown in FIG. 3 will be described first with reference to the timing chart of FIG. 5 when Data9 . . 0=0000011100b. Start pulse START is output from signal CLK and signal /RST input to the start pulse generation circuit 1. The counter 7 in the end pulse generation circuit 2 is reset by signal CLK and signal /RST input to the counter. The counter then starts counting signal CLK from 0 and outputs a count value (shown as "Counter" in FIG. 5) in synchronization with signal CLK. The comparator compares this count value and the value of Data9 . . 2 which is upper eight bits of Data9 . . 0 and generates end pulse END when these values become equal to each other. The value of Data9 . . 2 at this time corresponds to the count value obtained by count from the start pulse to the end pulse corresponding to V4.

Thereafter, when START signal generated in the start pulse generation circuit 1 and END signal generated in the end pulse generation circuit 2 are input to the delay circuit 3, signals ST0 to ST3 and ED0 to ED4 synchronized with signal CLK are output from the delay circuit 3.

Further, from signals ST0 to ST3 and ED0 to ED4 input to the decoding circuit 4, and signal Data1 . . 0 (=00b) and signal PHM1 . . 0 (=11b), STP1 to STP4 and EDP1 to EDP4 are obtained and input to the JK-FFs in the PWM generation circuit 5, and PWM output waveforms PWM1 to PWM4 for the drive signal potentials are output from the PWM generation circuit 5.

In comparison with the state shown in FIG. 5, the state shown in FIG. 6 when Data9 . . 0=0000011101b is such that signal EDP1 shown in FIG. 6 is one CLK (=1 slot) delayed relative to that in the state shown in FIG. 5 when Data9 . . 0=0000011100b, and signal PWM1 is extended by 1CLK.

In the state shown in FIG. 7 when Data9 . . 0=0000011110b, signal EDP2 is also delayed by 1CLK, and signal PWM2 is extended by 1CLK. Signal PWM1 is the same as that shown in FIG. 6.

In the state shown in FIG. 8 when Data9 . . 0=0000011111b, signal EDP3 is also delayed by 1CLK similarly, and signal PWM3 is extended by 1CLK. Signals PWM2 and PWM3 are the same as those shown in FIG. 7.

Thus, gradation waveforms shown in FIG. 2 can be formed by the circuit shown in FIG. 3.

However, the present invention is not limited to the circuit shown in FIG. 3. The PWM circuit 5 may be constituted by RS-FFs, and the decoding circuit 5 may be formed of a different circuit.

In the circuit arrangement shown in FIG. 1, the counter circuit and the comparator sections of the end pulse generation circuit 2, which are liable to become larger in scale, can be made compact by forming the delay circuit in the block 3, forming the decoding circuit in the block 4.

Figure 9:
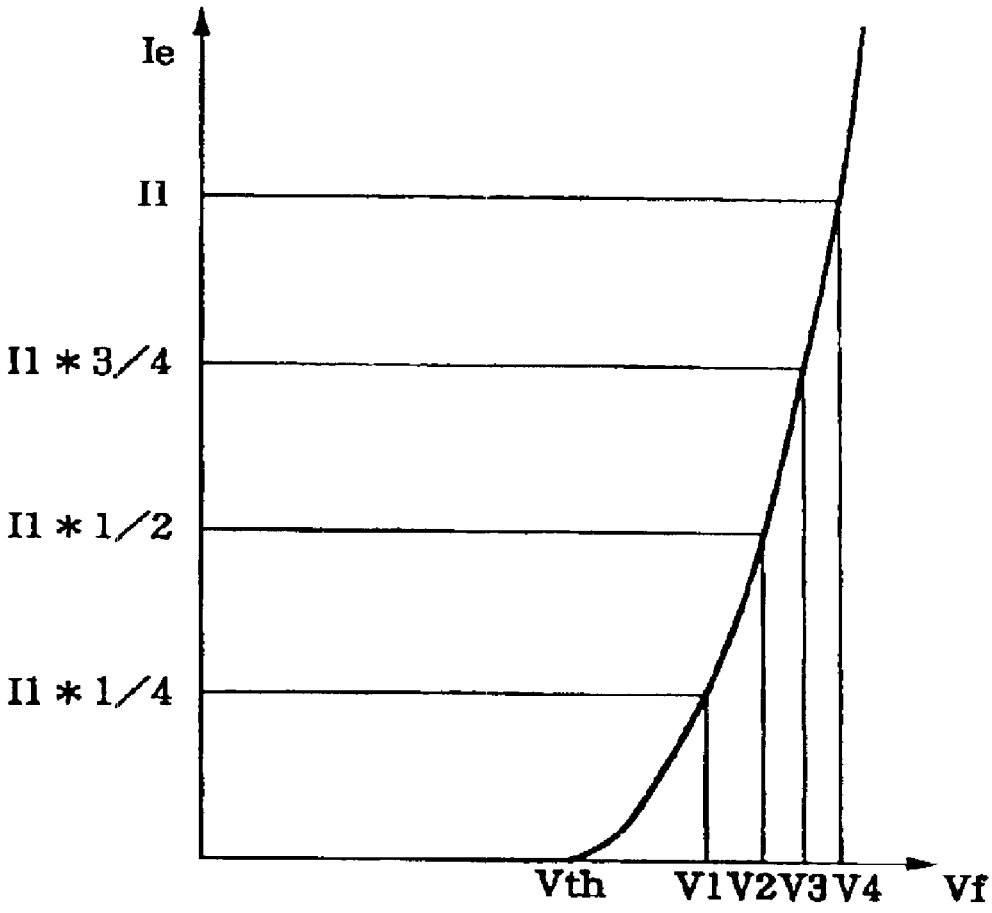
FIG. 9 is a graph showing the relationship in characteristics between the applied voltage (Vf) and emission current (Ie) in a cold-cathode electron-emitting device.

FIG. 9 shows an applied voltage (Vf)-emission current (Ie) characteristic of a cold-cathode electron-emitting device. The cold-cathode electron-emitting device emits electrons at a voltage equal to or higher than a certain threshold voltage Vth. The potential applied to this device and having the difference from the selecting potential in correspondence with the applied voltage in this characteristic when the emission current is Ie=I1 is set as V4; the potential applied to this device and having the difference from the selecting potential in correspondence with the applied voltage in this characteristic when Ie=I1*¾ is set as V3; the potential applied to this device and having the difference from the selecting potential in correspondence with the applied voltage in this characteristic when Ie=I1*½ is set as V2; and the potential applied to this device and having the difference from the selecting potential in correspondence with the applied voltage in this characteristic when Ie=I1*¼ is set as V1, thus enabling expression of gradations by the drive signal waveform shown in FIG. 2.

This example has been described with respect to drive of a cold-cathode electron-emitting device which is an example of the light-emitting device. However, other light-emitting devices or semiconductor devices can also be driven by the circuits of this example if expression of gradations by the drive signal waveform shown in FIG. 2 can be made by using the devices.

Figure 10:
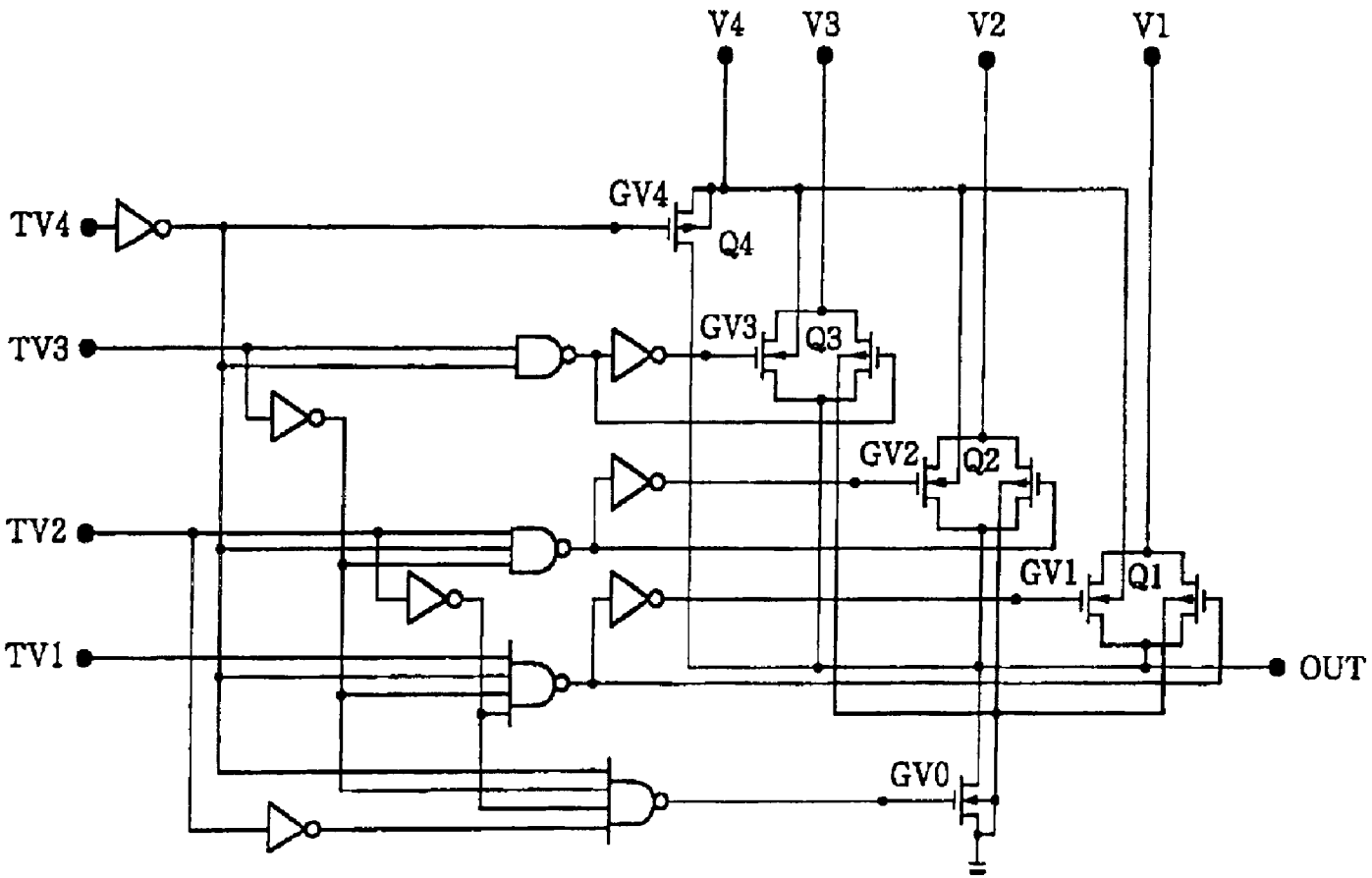
FIG. 10 is a circuit diagram showing an example of the output circuit shown in FIG. 1.
Figure 11:
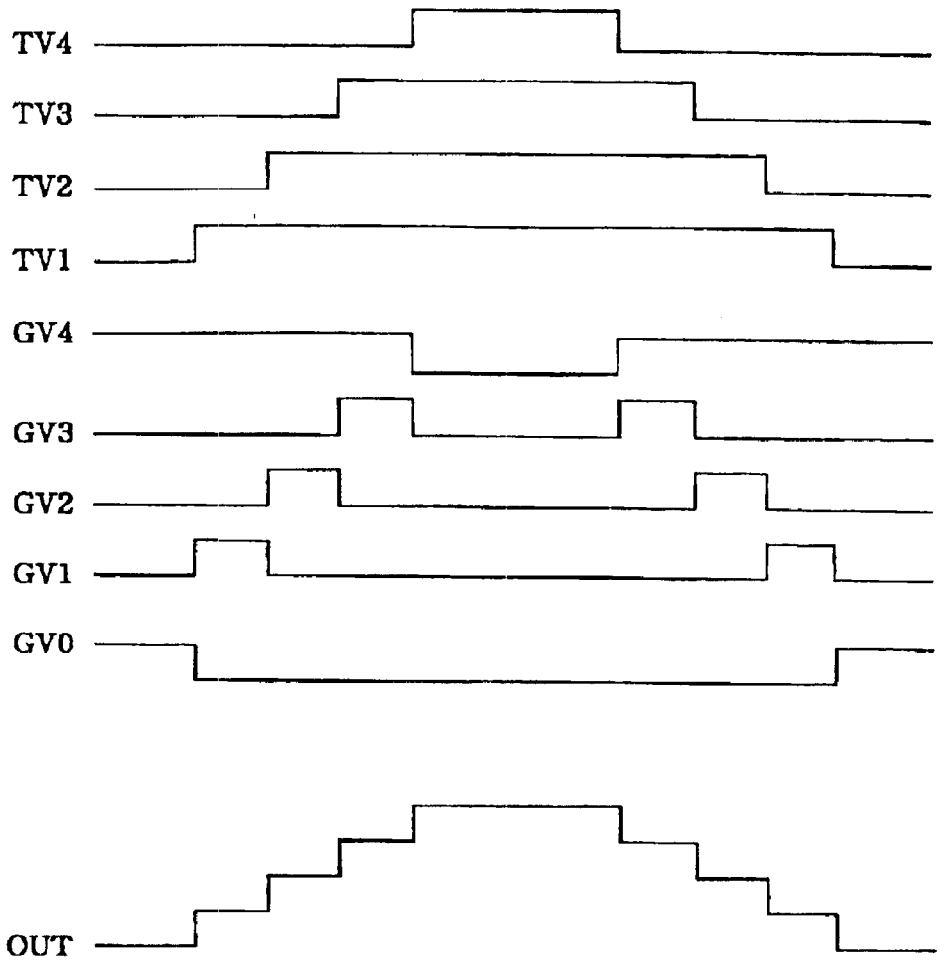
FIG. 11 is a timing chart for explaining the operation or the circuit shown in FIG. 10.

FIG. 10 shows an example of the output circuit 6 shown in FIG. 1. In the circuit shown in FIG. 10, potentials V1 to V4 are in a relationship 0<V1<V2<V3<V4 and are respectively output in correspondence with PWM output waveforms PWM1 to PWM4. A signal level conversion circuit (not shown) converts PWM1 to PWM4 into TV1 to TV4 having levels suitable for input to Q1 to Q4. However, PWM1 to PWM4 may be directly used as TV1 to TV4 without being processed in the signal level conversion circuit, depending on the configuration of the output circuit 6. TV1 to TV4 coincide with PWM1 to PWM4 with respect to time. Q1 to Q4 are transistors or transistor pairs which are turned on according to TV1 to TV4 to respectively output potentials V1 to V4 to the output terminal OUT. TV1 to TV4 corresponding to outputs PWM1 to PWM4 from the PWM generation circuit 5 are input to gates GV1 to GV4 through logic circuits which are arranged so that even when two or more of TV1 to TV4 are high level, two or more of the transistors Q1 to Q4 are not simultaneously turned on, and so that only the highest of potentials V1 to V4 corresponding to some of TV1 to TV4 at high level is output to the output terminal OUT. FIG. 11 shows an example of the waveforms of TV1 to TV4, GV4 to GV0, and OUT.

Figure 12:
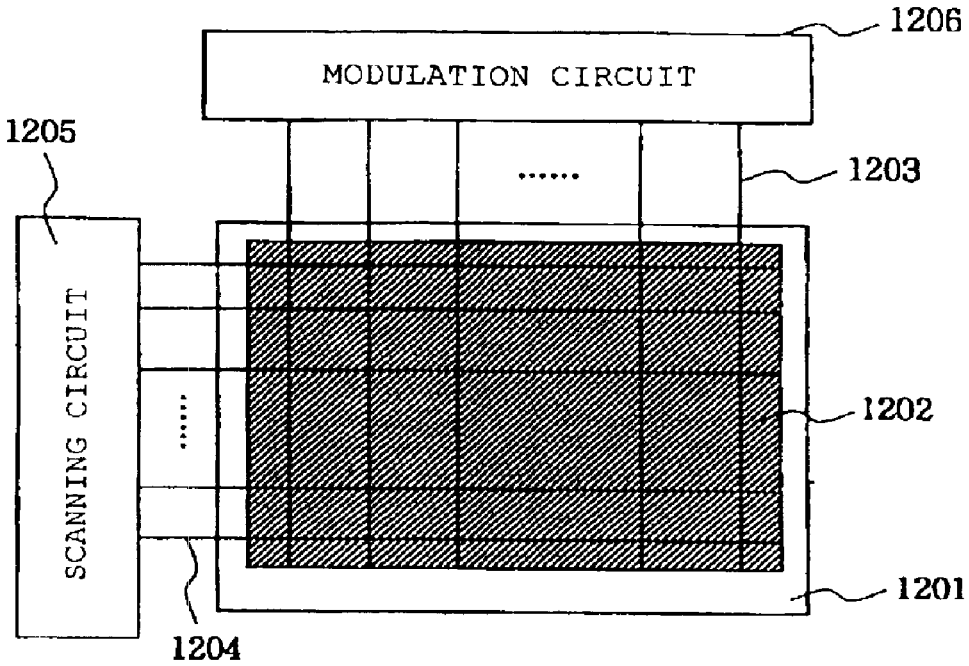
FIG. 12 is a schematic diagram showing the configuration of an image display apparatus in accordance with the present invention.

FIG. 12 shows the configuration of an image display apparatus of this example.

An electron source in which electron-emitting devices are formed is indicated by 1201. A modulation circuit 1206 includes the above-described drive signal generation circuits provided in correspondence with modulation wirings 1203. A circuit 1205 performs scanning drive through scanning wirings 1204 by applying the selecting potential to a selected one of the scanning wirings while applying the non-selecting potential to the unselected scanning wirings. A phosphor is indicated by 1202. The electron-emitting devices are provided at points of intersection of scanning wirings 1204 and modulation wirings 1203. Each electron-emitting device emits electron when the above-described drive signal is applied to it. Phosphor 1202 are irradiated with the emitted electrons to emit light, thus displaying an image.

According to the present invention described above with respect to concrete examples thereof, a simple and low-cost circuit can be used to realize a drive signal waveform which rises and/or falls in a stepping manner.

(Second Embodiment)

A second preferred embodiment of a drive signal generation circuit according to the present invention, is described below by using symbols shown in FIG. 13. The drive signal generation circuit comprises:

synchronization clock signal CLK for setting the time width of the above-mentioned slot;

start trigger signal TRG for setting a start of the above-described drive signal; and control data including first data signal PHM1 . . 0 for setting the wave height value Vm of the above-described drive signal, second data signal Data9 . . 2 for setting the width of a pulse having the wave height value Vm, third data signal Data1 . . 0 for setting the stepped shape of the falling portion, and a rise sync/fall sync change signal FR (these control data items are prepared on the basis of the input gradation data), the counter 7 being reset by the start trigger signal TRG and counting the synchronizaiton clock signal CLK, and is also characterized in that at least the start pulse circuit 1 (circuit A), the end pulse generation circuit 2 (circuit D) and the delay circuit 3 (the first delay circuit (circuit B) the second delay circuit (circuit E)) are controlled by synchronization clock signal CLK;

the start pulse generation circuit 1 is controlled by start trigger signal TRG, the counter output and rise sync/fall sync change signal FR;

the end pulse generation circuit 2 is controlled by start trigger signal TRG, second data signal Data9 . . 2, the counter output and rise sync/fall sync change signal FR;

the decoding circuit 4 (a portion of the circuit C, the circuit for generating the control signal) is controlled by third data signal Data1 . . 0 and first data signal PHM1 . . 0; and second data signal Data9 . . 2 in the case of fall synchronization is data corresponding to the difference between data for setting the limit position of the trailing end of the output Vm and second data signal Data9 . . 2 at the rise point. For example, if the limit position setting data is Full Data in which all bits are "1", i.e., $2^P-1$ of P-bit data, second data signal Data9 . . 2 in the case of fall synchronization is a complement to second data signal Data9 . . 2 at the rise point.

The same components as those in the first embodiment are indicated by the same reference characters, and the description for them will not entirely be repeated.

Figure 15:
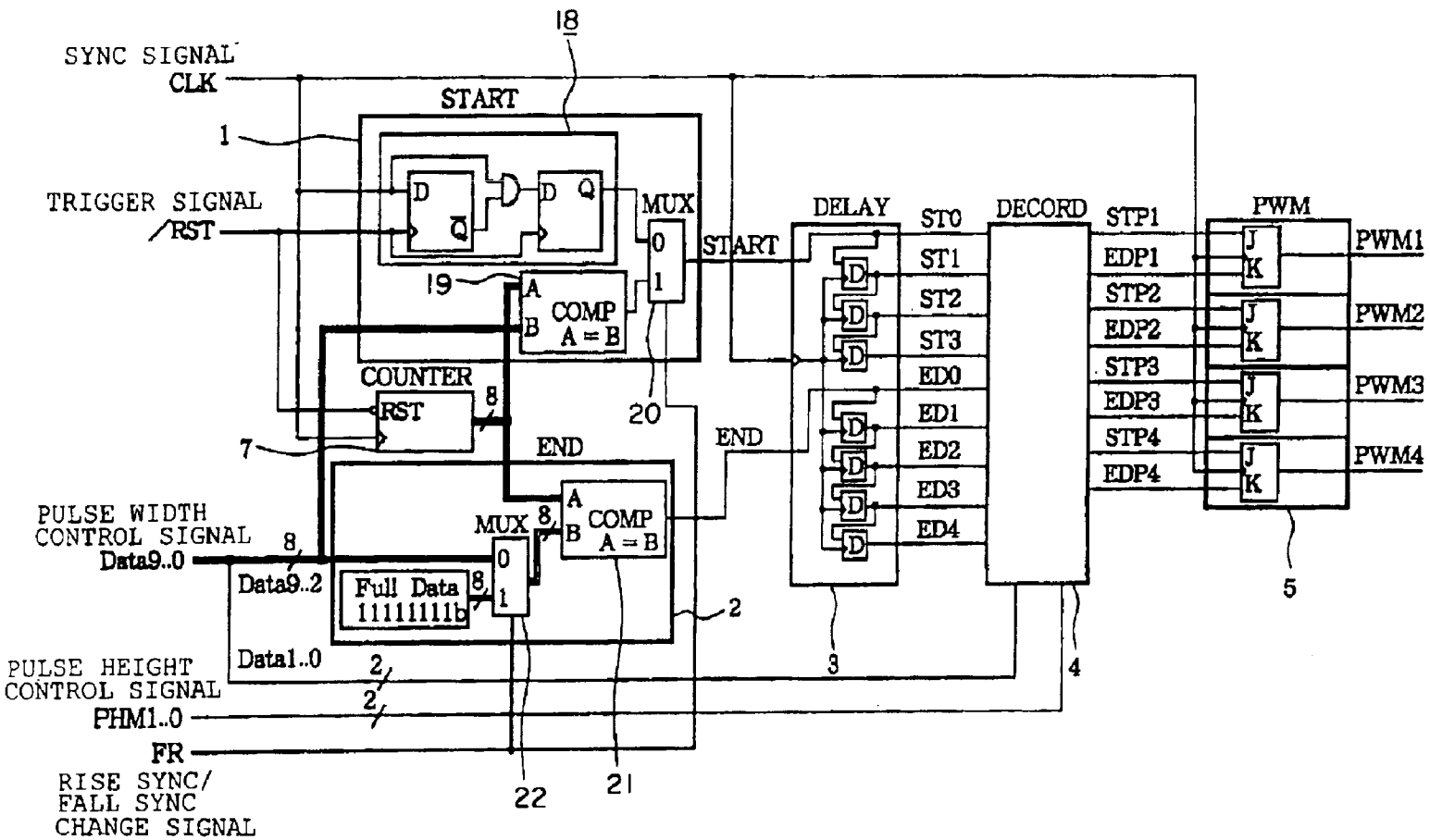
FIG. 15 is a circuit diagram showing an example of details of the circuit shown in FIG. 13.

More specifically, referring to FIG. 15, the start pulse generation circuit 1 has a start pulse circuit 18 which generates a first pulse in synchronization with the synchronization clock signal CLK on the basis of start trigger signal (shown as reset signal /RST in FIG. 15), a comparator 19 which generates a second pulse when the count value of the counter 7 and second data signal Data9 . . 2 coincide with each other, and a first selecting circuit 20 which selects one of the first and second pulses as start pulse START on the basis of rise sync/fall sync change signal FR.

The end pulse generation circuit 2 has a second selecting circuit 22 which selects one of second data signal Data9 . . 2 and the limit position setting data (11111111b) on the basis of rise sync/fall sync change signal FR, and a comparator 21 which generates an end pulse END when data output from this second selecting circuit 21 and the count value of the counter 7 coincide with each other.

The delay circuit 3 outputs start pulse START without a delay (ST0) and outputs (n−1) number of delayed outputs ST1, ST2, and ST3 by delaying start pulse START by (j−1) slots with respect to each j in $2 \leqq j \leqq n$. Further, the delay circuit 3 outputs end pulse END without a delay (ED0) and outputs n number of delayed outputs ED1, ED2, ED3, and ED4 by delaying end pulse END by j slots with respect to each j in $1 \leqq j \leqq n$.

In an example described below, the start pulse output from the start pulse generation circuit is output from the delay circuit without a delay, and the first rise (output V1) of the drive signal waveform is synchronized with this start pulse. That is, the start pulse generation circuit is formed as a start pulse output circuit. Similarly, the end pulse generation circuit is also formed as an end pulse output circuit. ST0 and ED0 may be directly output from the start pulse generation circuit and the end pulse generation circuit to the decoding circuit 4 without being passed through the delay circuit 3.

In the example described below, the start pulse output from the start pulse generation circuit is used as start signal ST0 with which the rise of V1 which is the lowest wave height value is synchronized. However, a pulse obtained by delaying the start pulse output from the start pulse generation circuit by $\alpha$ slots ($\alpha \geqq 0$) may alternatively be used as ST0. When this pulse is used, delayed outputs ST1, ST2, and ST3 are obtained by successively being delayed from ST0 in one-slot steps. Also, while the end pulse output from the end pulse generation circuit is used as signal ED0 with which the fall of the signal level from the maximum wave height value determined by luminance data is synchronized, a pulse obtained by delaying the end pulse output from the end pulse generation circuit by $\alpha$ slots ($\alpha \geqq 0$) may alternatively be used as ED0. When this pulse is used, delayed outputs ED1, ED2, and ED3 are obtained by successively being delayed from ED0 in one-slot steps.

The decoding circuit 4 selects, as output start pulse STPk of each output Vk, one of ST0 corresponding to start pulse and (n−1) number of delayed outputs ST1 to ST3 with delays from ST0 on the basis of first data PHM1 . . 0 and third data Data1 . . 0. ST0 to ST3 respectively correspond to STP1 to STP4. The decoding circuit 4 also selects, as output end pulse EDPk for each output Vk, one of ED0 corresponding to the end pulse and n number of delayed outputs ED1 to ED4 with delays from ED0. ED0 corresponds to EDP4. Also, ED1, ED2, and ED3 respectively correspond to EDP3, EDP2, and EDP1, or three of ED1 to ED4 correspond in their consecutive order to EDP3 to EDP1.

The pulse width generation circuit 5 outputs, as pulse width signals PWM1 to PWM4 for output Vk, signals each turned on by being timed to start pulse STPk of the corresponding output Vk and turned off by being timed to output end pulse EDPk of the output Vk.

This embodiment is also characterized by having an output circuit 6 which outputs each of the wave height values on the basis of pulse width signals PWM1 to PWM4, and which outputs only the highest wave height value in a case where on signals have occurred simultaneously with respect to two or more outputs Vk.

Also in this embodiment, in the same manner as the first embodiment, An electron-emitting device is adopted as a load. Light is produced by irradiating a phosphor with electrons emitted by applying the above-described drive signal to the electron-emitting device. A surface conduction type of emitting device, in particular, is adopted as the electron-emitting device. In an image display arrangement, in the same manner as the first embodiment, surface-conduction emitting devices are used as electron-emitting devices which are connected in matrix form by a plurality of scanning wirings and a plurality of modulation wirings.

As the signal level, either of selection among potential values and selection among current values may be made. If selection is made among current values, a plurality of current sources are provided in place of the plurality of potential sources in the output circuit 6. The time period during which each current source causes a predetermined current to flow (including a case where current is drawn in) may be controlled in accordance with the present invention and the sum of the currents caused by the current sources may be supplied to the load.

SECOND EXAMPLE

An example of the second embodiment of the present invention will be described. FIG. 13 shows a drive signal generation circuit according to the second embodiment of the present invention. For example, this circuit is used to drive each of electron-emitting elements arranged at points of intersection of a plurality of column-direction (modulation) wiring lines and a plurality of row-direction (scanning) wiring lines in a matrix display. One drive signal generation circuit is used in correspondence with each of the column-direction wiring lines. FIG. 13 shows a start pulse generation circuit 1, an end pulse generation circuit 2, a delay circuit 3, a decoding circuit 4, a PWM generation circuit 5, an output circuit 6, and a counter circuit 7. This arrangement enables gradation waveforms (drive signal waveforms) to be formed by using both pulse width modulation (PWM) and pulse amplitude modulation (PAM) as shown in FIGS. 2 and 14. In FIGS. 2 and 14, each of hatched portions represents an increase in luminance as one gradation step. FIG. 2 shows a rise-synchronized waveform formed in such a manner that the positions of rises of gradation waveforms applied to the plurality of column-direction wiring lines are synchronized with each other. FIG. 14 shows a fall-synchronized waveform formed in such a manner that the positions of falls of gradation waveforms applied to the plurality of column-direction wiring lines are synchronized with each other. The circuit in which four amplitude levels (wave height values) are realized by using V1 to V4 potential selecting drive, and which outputs gradations corresponding to 10 bits as a total number of gradations will be described. The reference potential used as a basis for the signal level of the waveform of the drive signal may be determined according to the potential applied to the scanning wirings at such a level that unnecessary emission of light can be suppressed. In this embodiment, the reference potential is set to ground potential.

Figure 13:
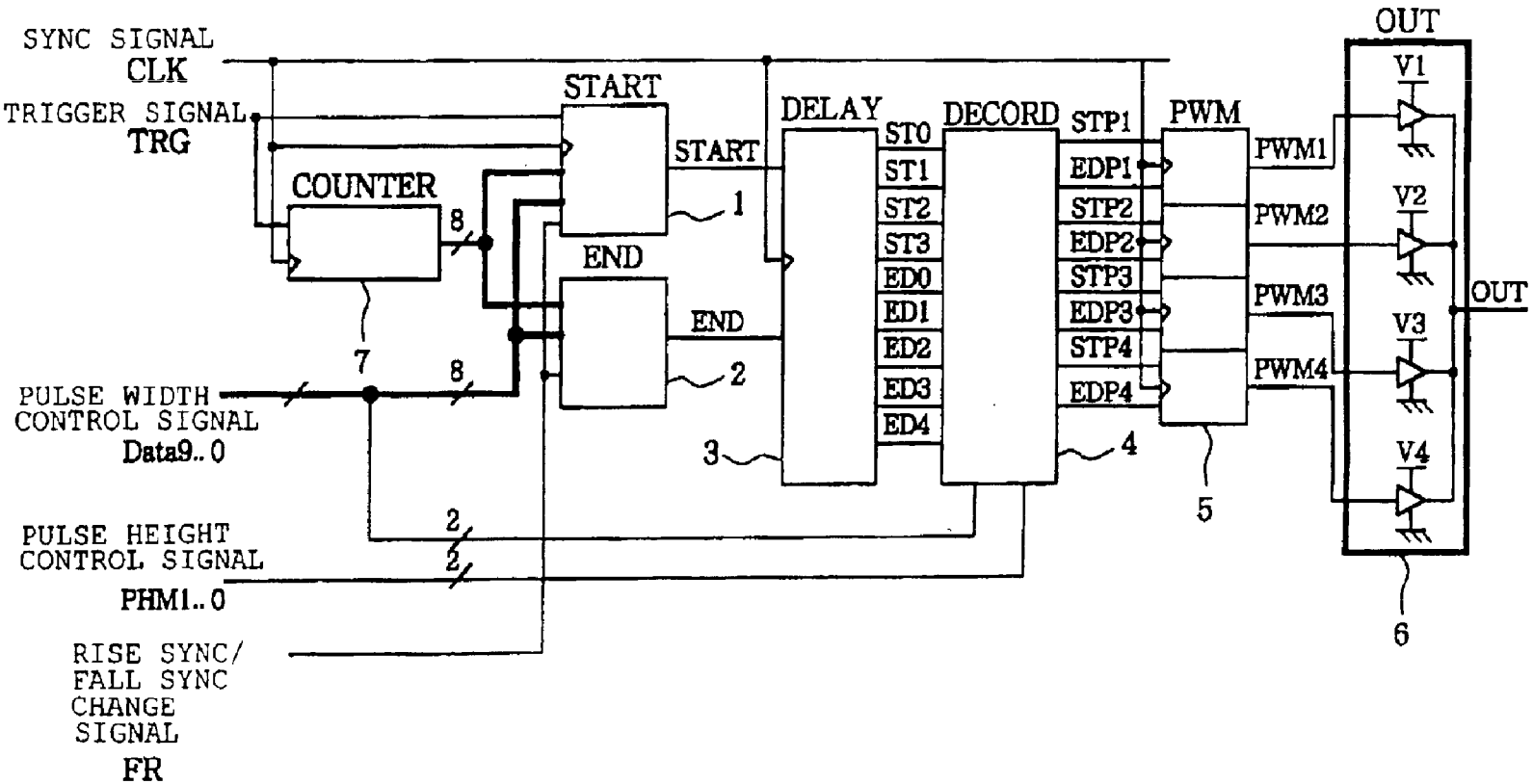
FIG. 13 is a block diagram showing the configuration of a drive signal generation circuit in a second embodiment of the present invention.
Figure 14:
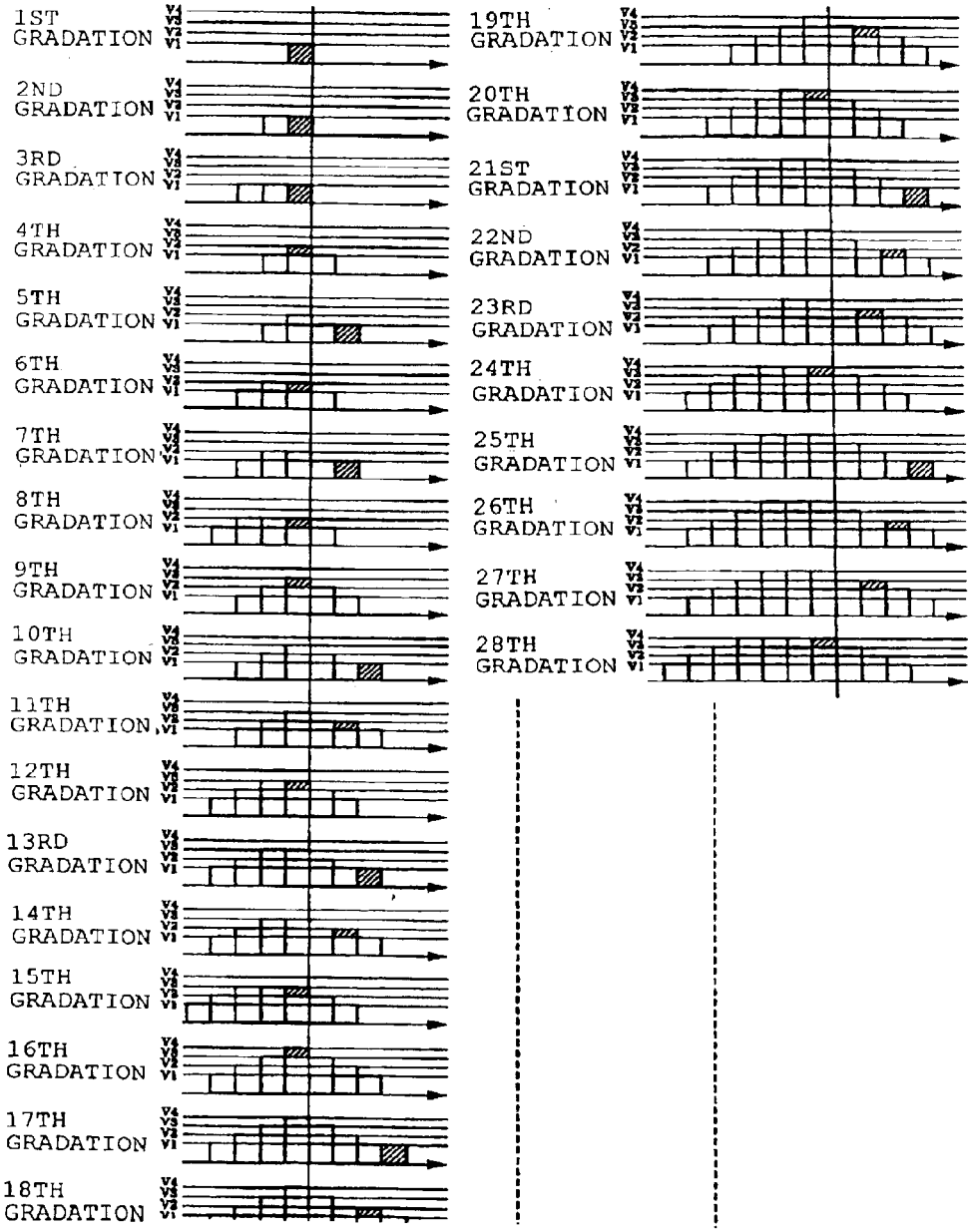
FIG. 14 is a waveform diagram showing a drive signal waveform in the case of fall synchronization which is an example of a drive signal waveform to be realized by the present invention.

Referring to FIG. 13, to enable the gradation waveforms shown in FIGS. 2 and 14 to be formed by the same circuit configuration, synchronization signal CLK for synchronization between timings of the circuits therein is input to the counter circuit 7, the start pulse generation circuit 1, the end pulse generation circuit 2, the delay circuit 3, and the PWM generation circuit 5. Synchronization signal CLK may be input to the decoding circuit 4 in some case. Trigger signal TRG is input to the counter circuit 7, the start pulse generation circuit 1 and the end pulse generation circuit 2 as a timing signal. Further, rise sync/fall sync change signal FR is input to the start pulse generation circuit 1 and the end pulse generation circuit 2.

Pulse-width control signal Data9 . . 0 is a 10-bit control signal (data) for controlling the time width of the drive signal waveform. Pulse-height control signal PHM1 . . 0 is a 2-bit control signal. (data) for controlling the wave height value or the amplitude (signal level of the drive signal) of the drive signal waveform. Rise sync/fall sync change signal FR is a 1-bit signal, "0" corresponding to rise synchronization, "1" corresponding to fall synchronization. Pulse-height control signal PHM1 . . 0 indicates which one of the first to fourth levels, i.e., the wave height values V1 to V4 the maximum wave height value (Vm) of the drive signal waveform corresponds to. The upper eight bits of pulse width control signal Data9 . . 0 indicate, in the case of rise synchronization (FR=0), the position at which the drive signal waveform falls (end pulse generation timing) in terms of the number of slots (0 to 255) from the predetermined rise position (start pulse generation timing) and indicates, in the case of fall synchronization (FR=1), the amount of delay of the rise position of the drive signal waveform from the rise position in the case of rise synchronization in terms of the number of slots (0 to 255). The lower two bits of pulse width control signal Data9 . . 0 indicate none or one of the first to third levels for which a delay slot width of 2 is set (the wave height value maintained for the time period corresponding to two slots in the stepped shape of the falling portion) as an expression of the stepped shape of the falling portion of the waveform. These control signals are prepared by a display controller (not shown) such as a microprocessor or a graphic controller on the basis of the above-mentioned gradation data corresponding to ten bits, and are input to this drive signal generation circuit. When the display controller outputs "1" as rise sync/fall sync change signal FR (fall synchronization), it outputs, as upper 8-bit data in pulse width control signal Data9 . . 0, a complement to the upper 8-bit data to be output when FR=0 (rise synchronization).

The upper eight bits (Data9 . . 2) in the pulse width control signal Data9 . . 0 are input to the end pulse generation circuit 2, while the lower two bits (Data1 . . 0) and pulse height control signal PHM1 . . 0 are input to the decoding circuit 4.

In this example, to express gradation data of a data bit length R=10, pulse width control of unit pulses of a slot width of Δt in the range from 0 to 259 unit pulses is performed by using P=10 bits (Data9 . . 0) and amplitude control of the wave height level in the range from 1 to 4 levels, i.e., wave height values V1 to V4, is performed by using Q=2 bits (PHM1 . . 0) (in actuality, Q=2 bits influences pulse width control). That is, the above-described data items R, P, and Q for representation of 10-bit image data are in a relationship R<P+Q.

In a case where R=P+Q, and where, for example, the upper two bits are used for amplitude control while pulse width control is performed by using the other eight bits, image data expression using all the ten bits cannot be made if the falling portion of the drive signal wave form is stepped. That is, the number of gradations is reduced. In this example, however, pulse width control is performed by using P=10 bits, so that R<P+Q, thus enabling the entire gradation data having R=10 bits to be expressed.

From START signal and END signal respectively generated in the start pulse generation circuit 1 and the end pulse generation circuit 2, the delay circuit 3 forms signals ST0 to ST3 and ED0 to ED4 with delays of 0 to a certain number of steps. Signals STP1 to STP4 and EDP1 to EDP4 obtained by decoding these signals ST0 to ST3 and ED0 to ED4 by the lower bits (Data1 . . 0) of the pulse width control signal and pulse height control signal PHM1 . . 0 are used to output from the PWM generation circuit 5 pulse width signals PWM1 to PWM4 corresponding to V1 to V4. Rise sync/fall sync change signal FR is input to the start pulse generation circuit 1 and to the end pulse generation circuit 2. In the case of rise synchronization, the start pulse generation circuit 1 and the end pulse generation circuit 2 output start and end pulses for outputting drive signal waveforms such as those shown in FIG. 2, in which rise timings are synchronized. In the case of fall synchronization, the start pulse generation circuit 1 and the end pulse generation circuit 2 output start and end pulses for outputting drive signal waveforms such as those shown in FIG. 14, in which fall timings are synchronized. FIG. 15 shows an example of a circuit for generating the above-described signals.

Referring to FIG. 15, the start pulse generation circuit 1 has a start pulse circuit 18 for rise synchronization constituted by a D-FF (delayed flip flop, a flip flop is also referred to as FF hereinafter) and an AND gate, a start pulse circuit for fall synchronization constituted by an 8-bit comparator 19 which compares the upper eight bits (Data9 . . 2) of pulse width control signal Data9 . . 0 and the count value of the counter 7, and a selecting circuit (MUX) 20 which selects the output from the two start pulse circuits by rise sync/fall sync change signal FR.

The end pulse generation circuit 2 is constituted by a selecting circuit (MUX) 22 which selects between 8-bit full data (=11111111b) and the upper eight bits (Data9 . . 2) of pulse width control data signal Data9 . . 0 by rise sync/fall sync change signal FR, and an 8-bit comparator 21 which compares the upper eight bits (Data9 . . 2) of pulse width control data Data9 . . 0 or 8-bit full data (=11111111b) output from the selecting circuit 22 with the count value of the counter 7. When the selecting circuit 22 selects the upper eight bits (Data9 . . 2) of pulse width control data signal, an end pulse circuit for rise synchronization is formed. When the selecting circuit 22 selects the full data (=11111111b), an end pulse circuit for fall synchronization is formed.

The delay circuit 3 is constituted by three D-FFs forming a first delay circuit (respectively outputting ST1, ST2, and ST3) and four D-FFs forming a second delay circuit (respectively outputting ED1, ED2, ED3, and DE4); the decoding circuit 4 is constituted by gate circuits; and the PWM generation circuit 5 is constituted by JK-FFs.

In this example, the delay circuit 3 and the decoding circuit 4 which selects delayed outputs according to luminance data are arranged to enable the end pulse generation circuit 2 provided in a simple configuration using one set of a counter and a comparator to form a signal for controlling the pulse widths for outputting four potential levels from the pulse width generation circuit 5. Referring to FIG. 15, the trigger signal is input as the reset signal (/RST) to the two D-FFs in the start pulse circuit 1 and to the counter 7 in the end pulse generation circuit 2. The slash added as a symbol for the reset signal indicates that the reset signal is a negative-logic signal, that is, the reset signal is normally high level and resets the D-FF and the counter 7 when it becomes low level.

Referring to FIG. 15, synchronization signal CLK for synchronization of timing between the circuits is input to the counter circuit 7, the start pulse generation circuit 1, the end pulse generation circuit 2, the delay circuit 3, and the PWM generation circuit 5. Synchronization signal CLK is also input to the decoding circuit 4 if necessary. Trigger signal /RST is input as a timing signal to the counter circuit 7, the start pulse generation circuit 1 and the end pulse generation circuit 2. Pulse width control signal Data9 . . 0 is a control signal (data) for controlling the time width (pulse width) of the drive signal waveform, and pulse height control signal PHM1 . . 0 is a control signal (data) for controlling the amplitude (wave height value). The upper eight bits (Data9 . . 2) of pulse width control signal Data9 . . 0 are input to the end pulse generation circuit 2, while the lower two bits (Data1 . . 0) and pulse height control signal PHM1 . . 0 are input to the decoding circuit 4.

START signal and END signal respectively generated in the start pulse generation circuit 1 and the end pulse generation circuit 2 are delayed 0 to a certain number of steps by the delay circuit 3 to form a plurality of signals ST0 to ST3 and ED0 to ED4. These delayed signals ST0 to ST3 and ED0 to ED4 are decoded into signals STP1 to STP4 and EDP1 to EDP4 by using control signals of Data1 . . 0 and wave height data PHM1 . . 0. From these signals STP1 to STP4 and EDP1 to EDP4, the PWM generation circuit 5 outputs pulse width signals (PWM1 to PWM4) corresponding to V1 to V4.

The start pulse generation circuit 1 and the end pulse generation circuit 2 are supplied with rise sync/fall sync change signal FR, generate start and end pulses for outputting drive signal waveforms such as those shown in FIG. 2 in the case of rise synchronization, and generate start and end pulses for outputting drive signal waveforms such as those shown in FIG. 14 in the case of fall synchronization. The decoding circuit 4 shown in FIG. 15 can be formed in the same manner as that of the first embodiment shown in FIG. 4.

The functions of the circuits shown in FIG. 15 will be described with reference to timing charts shown in FIGS. 16 to 23. FIGS. 16 to 19 are timing charts when rise synchronization is performed. FIGS. 20 to 23 are timing charts when fall synchronization is performed.

The circuit functions will first be described with respect to rise synchronization. When rise synchronization is performed, the selecting circuit 20 in the start pulse generation circuit 1 selects the output from the start pulse circuit 18 by rise sync/fall sync change signal FR=0, while the selecting circuit 22 in the end pulse generation circuit 2 selects the upper 8-bit data Data9 . . 2 of the pulse width control signal by rise sync/fall sync change signal FR=0, and outputs this data to the comparator 21.

Figure 16:
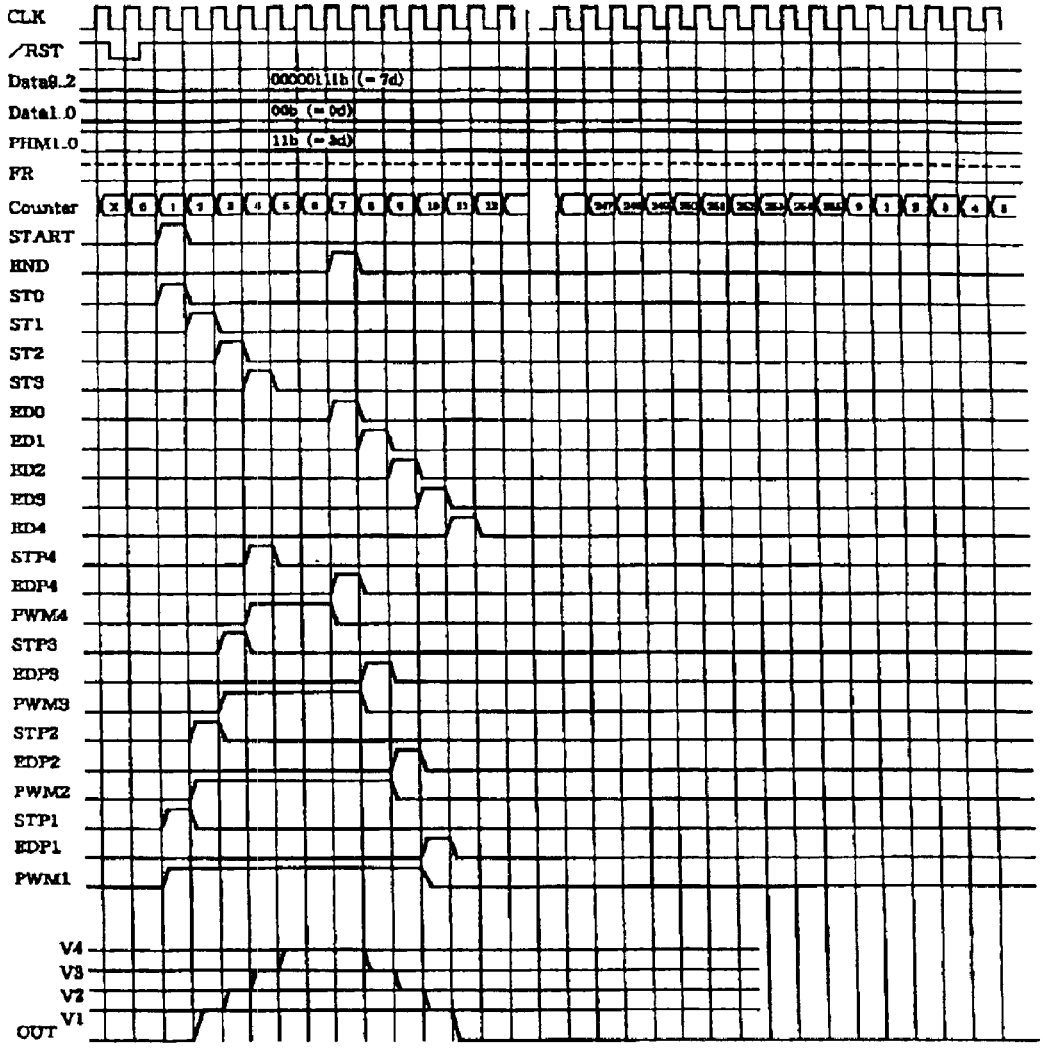
FIG. 16 is a timing chart for explaining the operation of the circuit shown in FIG. 15 in the case of rise synchronization.
Figure 17:
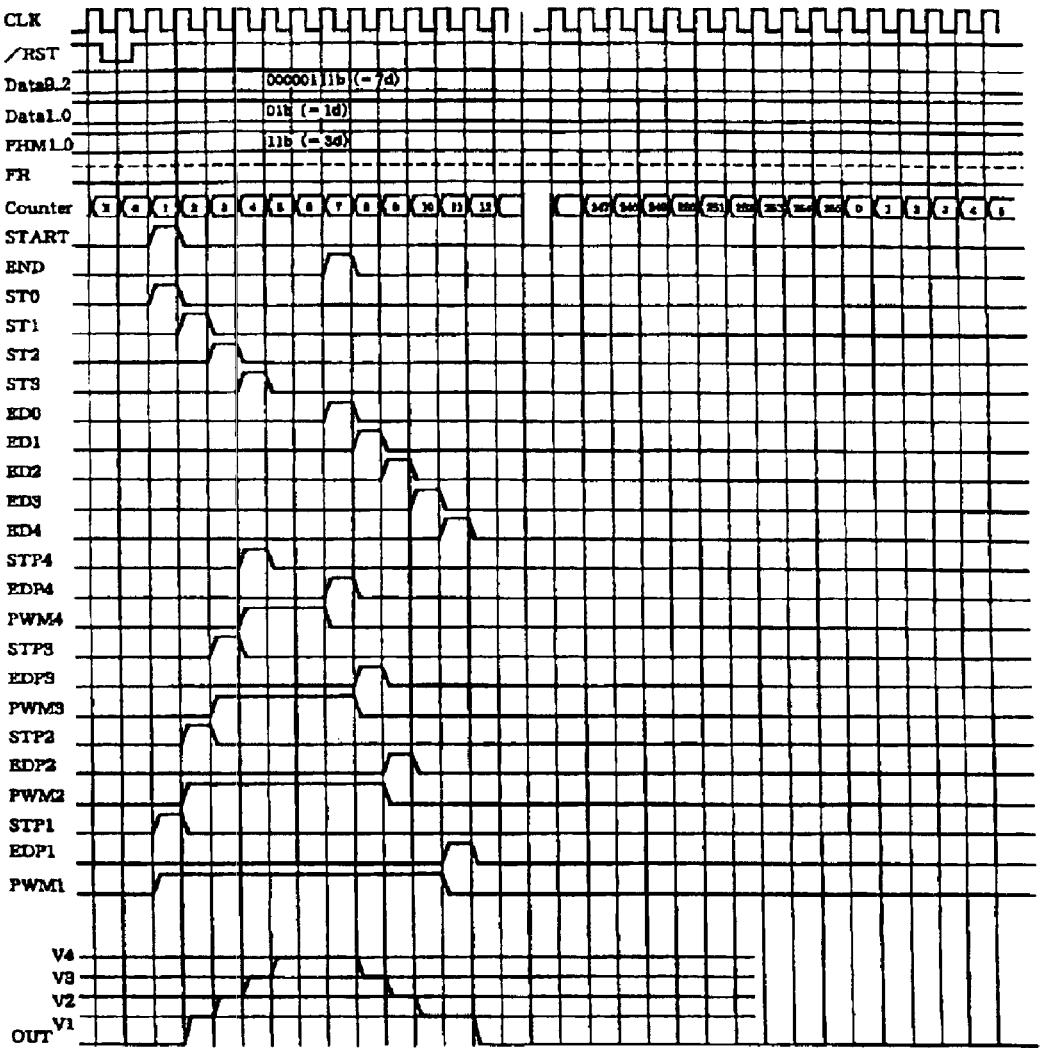
FIG. 17 is a timing chart for explaining the operation of the circuit shown in FIG. 15 in the case of rise synchronization.
Figure 18:
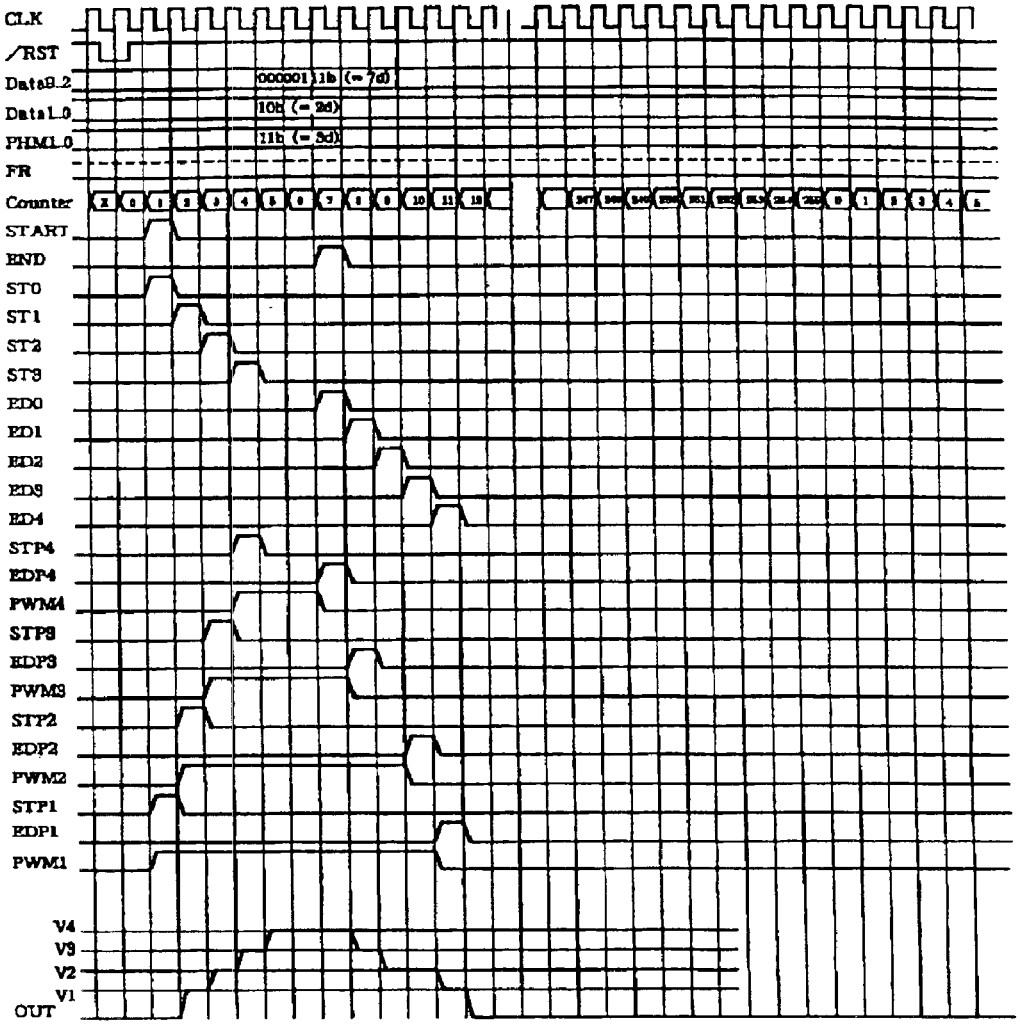
FIG. 18 is a timing chart for explaining the operation of the circuit shown in FIG. 15 in the case of rise synchronization.
Figure 19:
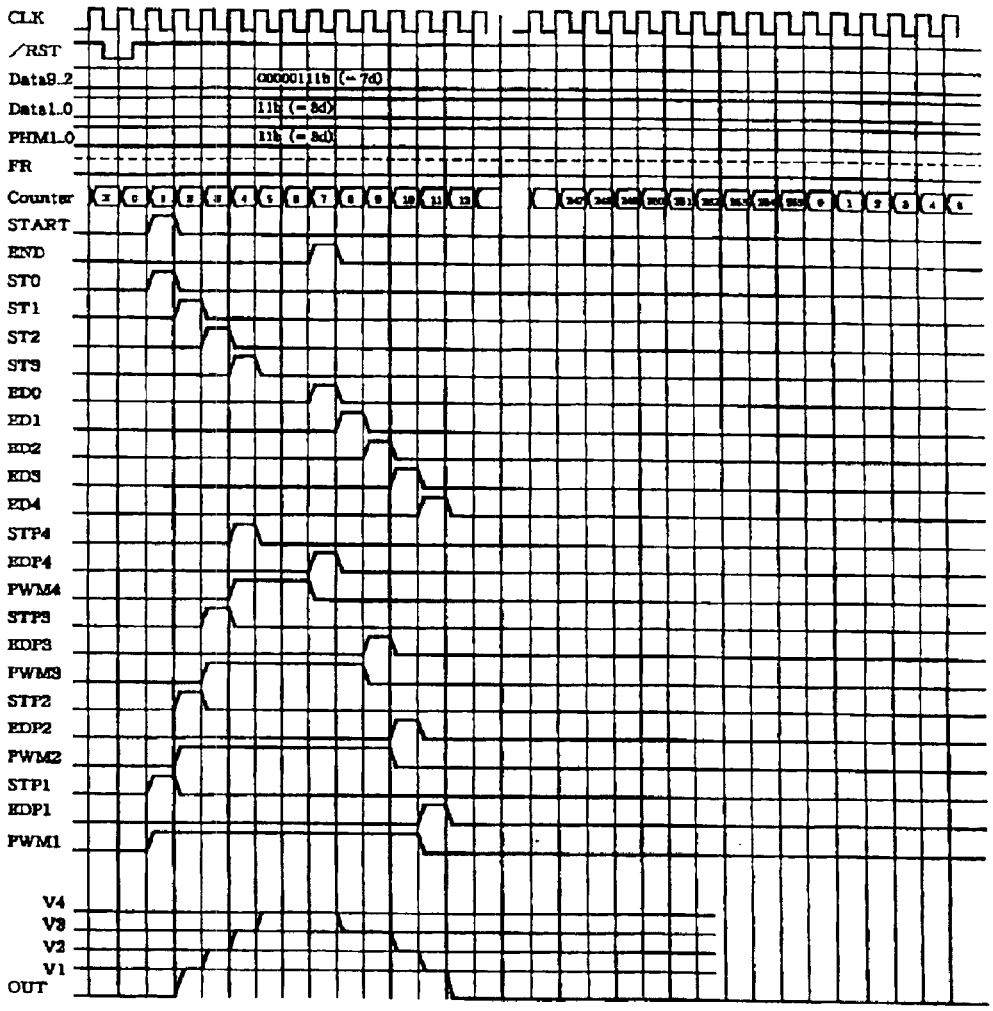
FIG. 19 is a timing chart for explaining the operation of the circuit shown in FIG. 15 in the case of rise synchronization.

FIG. 16 is a timing chart when Data9 . . 0=000001110b (24th gradation), FIG. 17 is a timing chart when Data9 . . 0=0000011101b (25th gradation), FIG. 18 is a timing chart when Data9 . . 0=0000011110b (26th gradation), and FIG. 19 is a timing chart when Data9 . . 0=0000011111b (27th gradation). PHM1 . . 0 signal is a control signal for controlling the drive voltage used (the wave height value of the signal level). If only V1 is used for the drive signal waveform, PHM1 . . 0=00b is input. If V1 and V2 are used for the drive signal waveform, PHM1 . . 0=01b is input. If V1 to V3 are used for the drive signal waveform, PHM1 . . 0=10b is input. If V1 to V4 are used for the drive signal waveform, PHM1 . . 0=11b is input. FIGS. 16 to 19 relate to the case where all potentials V1 to V4 are used for the drive signal waveform, and 11b is input as PHM1 . . 0.

The functions of the circuits shown in FIG. 15 will be described with reference to the timing chart of FIG. 16 when Data9 . . 0=0000011100b. The counter 7 is reset by signal CLK and signal /RST input to the counter 7, starts counting from 0, and outputs a count value ("Counter" in FIG. 16) in synchronization with signal CLK. The output from start pulse circuit 18 generated from signal CLK and signal /RST input to the start pulse generation circuit 1 is selected by the selecting circuit 20 to be output as START signal. In the end pulse generation circuit 2, the comparator 21 compares the value of the counter 7 and the value of the upper 8-bit data Data9 . . 2 in Data9 . . 0 selected by the selecting circuit 22, and generates END signal when these values becomes equal to each other. The value of Data9 . . 2 at this time corresponds to the value of the counter from the start pulse to the end pulse corresponding to V4.

Thereafter, when START signal generated in the start pulse generation circuit 1 and END signal generated in the end pulse generation circuit 2 are input to the delay circuit 3, signals ST0 to ST3 and ED0 to ED4 synchronized with signal CLK are output from the delay circuit 3.

Further, from signals ST0 to ST3 and ED0 to ED4 input to the decoding circuit 4, and signal Data1 . . 0 (=00b) and signal PHM1 . . 0 (=11b), signals STP1 to STP4 and EDP1 to EDP4 are obtained and input to the JK-FFs in the PWM generation circuit 5, and PWM output waveforms PWM1 to PWM4 for each of the drive signal potentials are output from the PWM generation circuit 5.

In comparison with the state shown in FIG. 16, the state shown in FIG. 17 when Data9 . . 0=0000011101b is such that signal EDP1 shown in FIG. 17 is one CLK (=1 slot) delayed relative to that in the state shown in FIG. 16 when Data9 . . 0=0000011100b, and signal PWM1 is extended by 1CLK.

In the state shown in FIG. 18 when Data9 . . 0=0000011110b, signal EDP2 is also delayed by 1CLK in similar, and signal PWM2 is extended by 1CLK. Signal PWML is the same as that shown in FIG. 17.

In the state shown in FIG. 19 when Data9 . . 0=0000011111b, signal EDP3 is also delayed by 1CLK, and signal PWM3 is extended by 1CLK. Signals PWM2 and PWM1 are the same as those shown in FIG. 18.

Thus, gradation waveforms in the case of rise synchronization shown in FIG. 2 can be formed by the circuit shown in FIG. 15.

The circuit functions will next be described with respect to fall synchronization. When fall synchronization is performed, the selecting circuit 20 in the start pulse generation circuit 1 selects the output from the comparator 19 by rise sync/fall sync change signal FR=1, while the selecting circuit 22 in the end pulse generation circuit 2 selects the full data=11111111b by rise sync/fall sync change signal FR=1, and outputs this data to the comparator 21.

Figure 20:
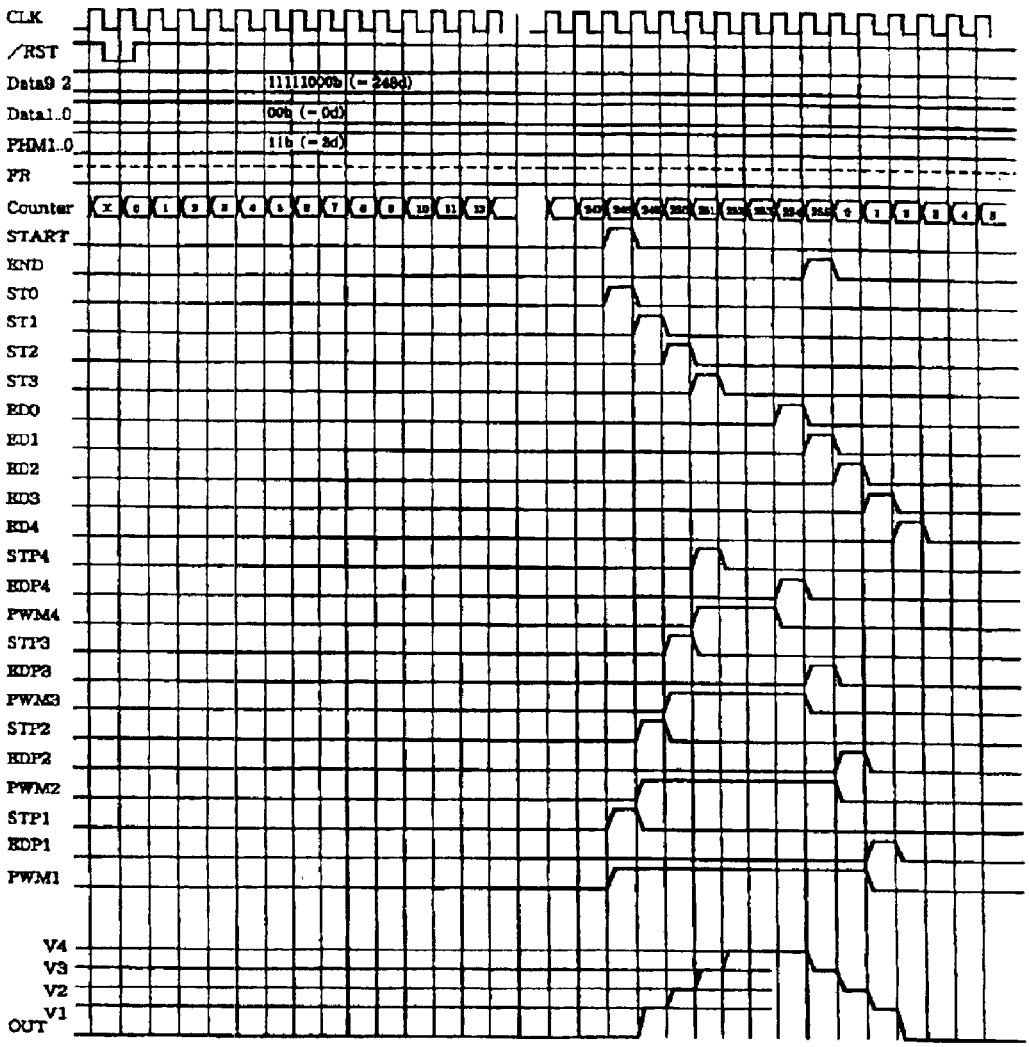
FIG. 20 is a timing chart for explaining the operation of the circuit shown in FIG. 15 in the case of fall synchronization.
Figure 21:
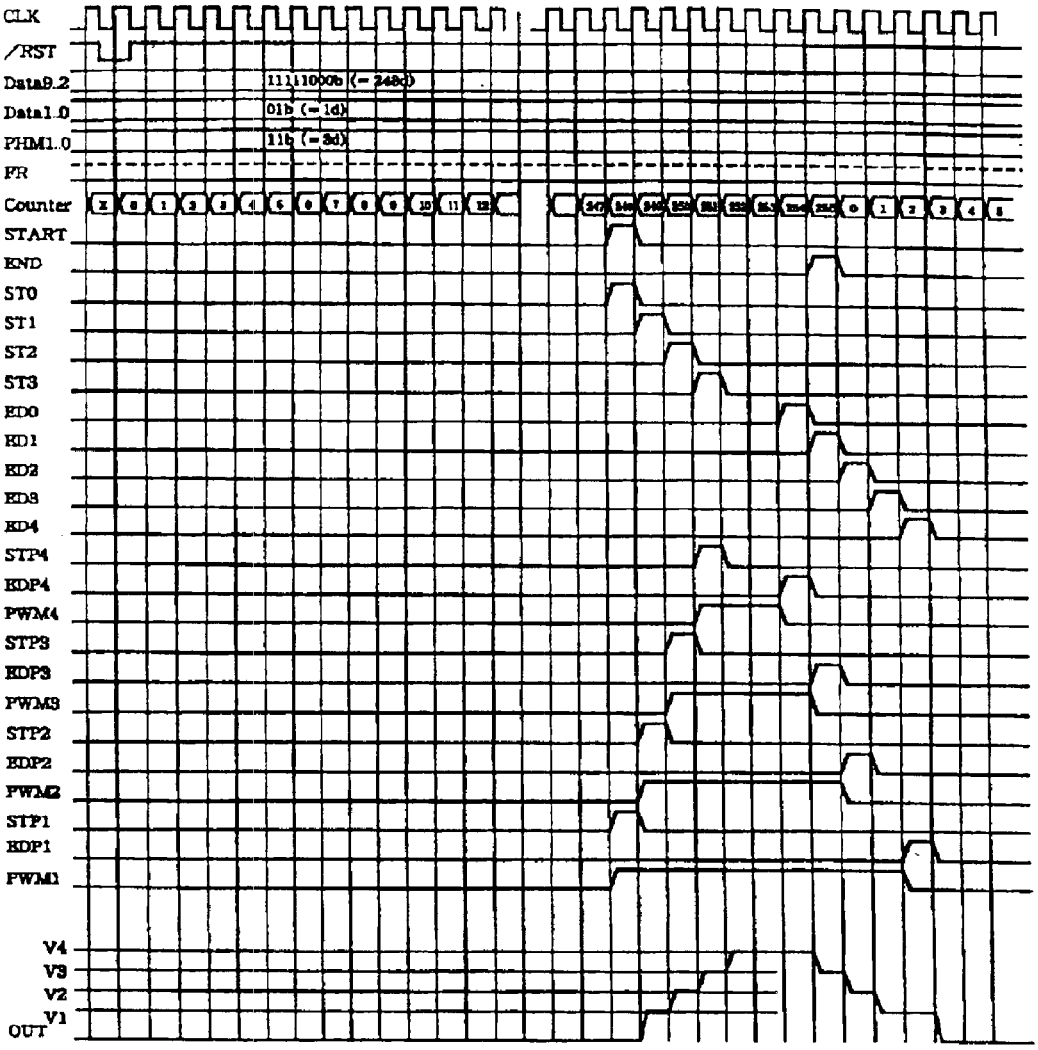
FIG. 21 is a timing chart for explaining the operation of the circuit shown in FIG. 15 in the case of fall synchronization.
Figure 22:
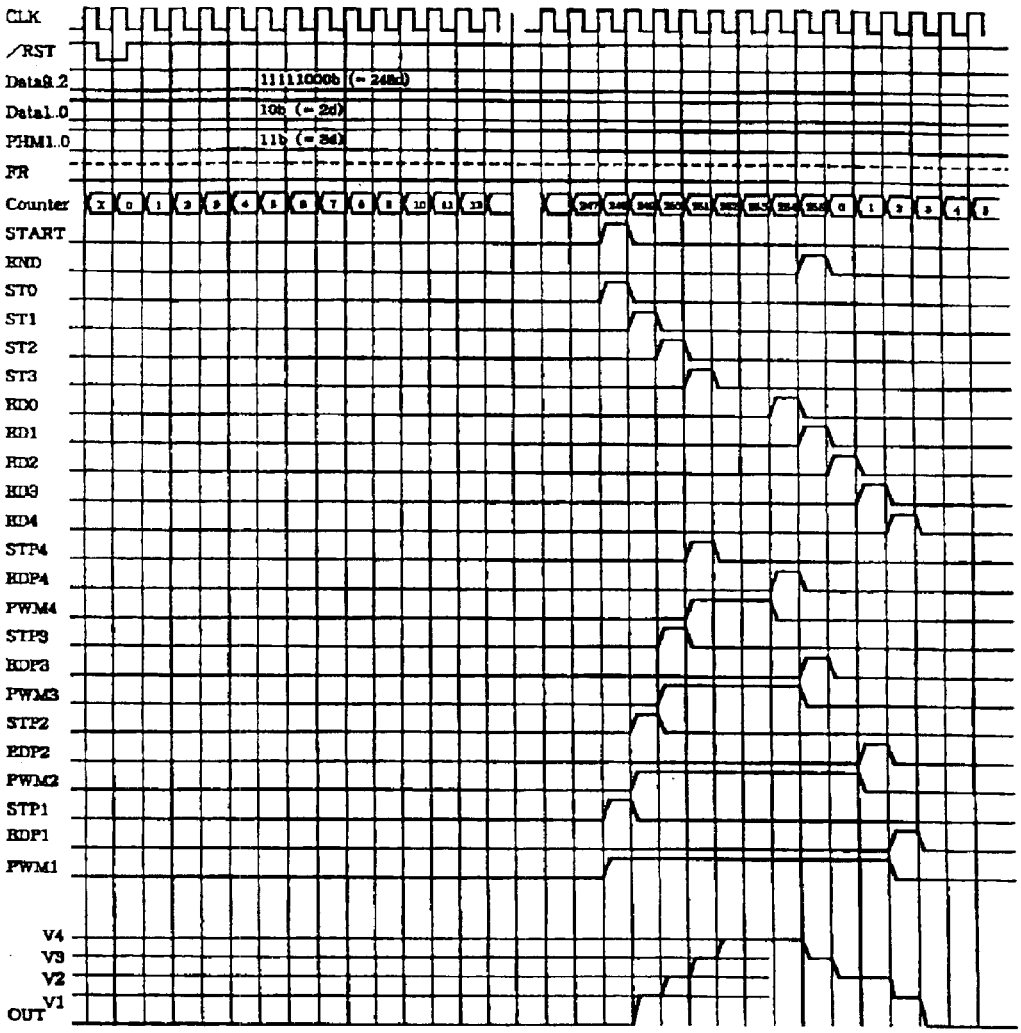
FIG. 22 is a timing chart for explaining the operation of the circuit shown in FIG. 15 in the case of fall synchronization.
Figure 23:
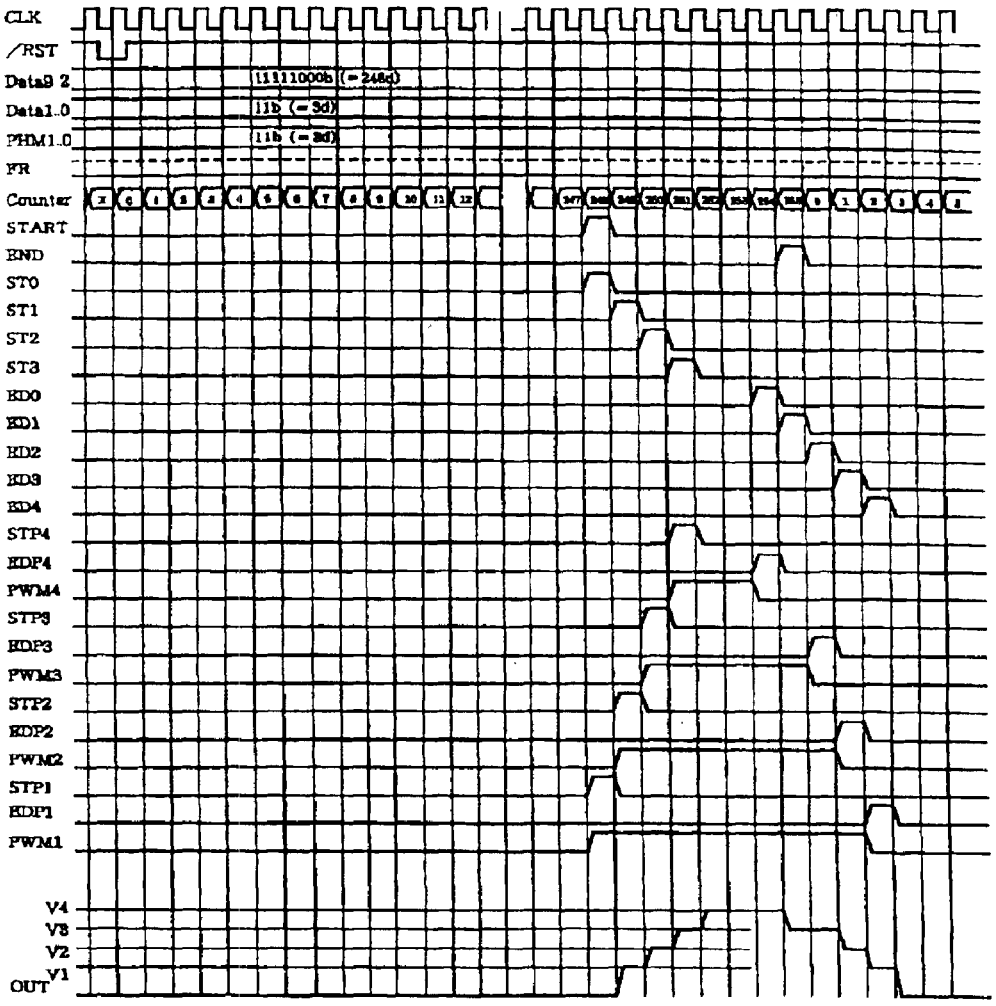
FIG. 23 is a timing chart for explaining the operation of the circuit shown in FIG. 15 in the case of fall synchronization.
Figure 24:
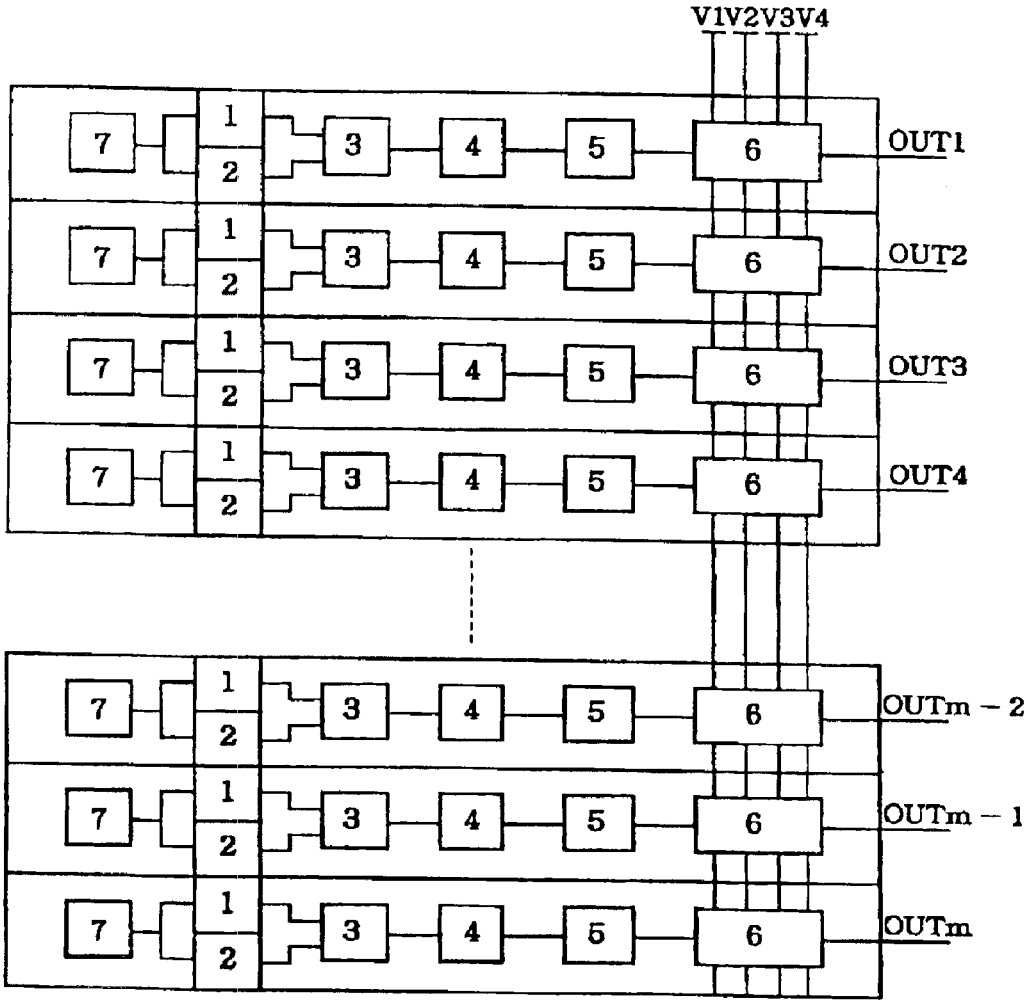
FIG. 24 is a connection diagram showing a state where m number of the circuits shown in FIG. 15 are arranged in parallel with each other.
Figure 25:
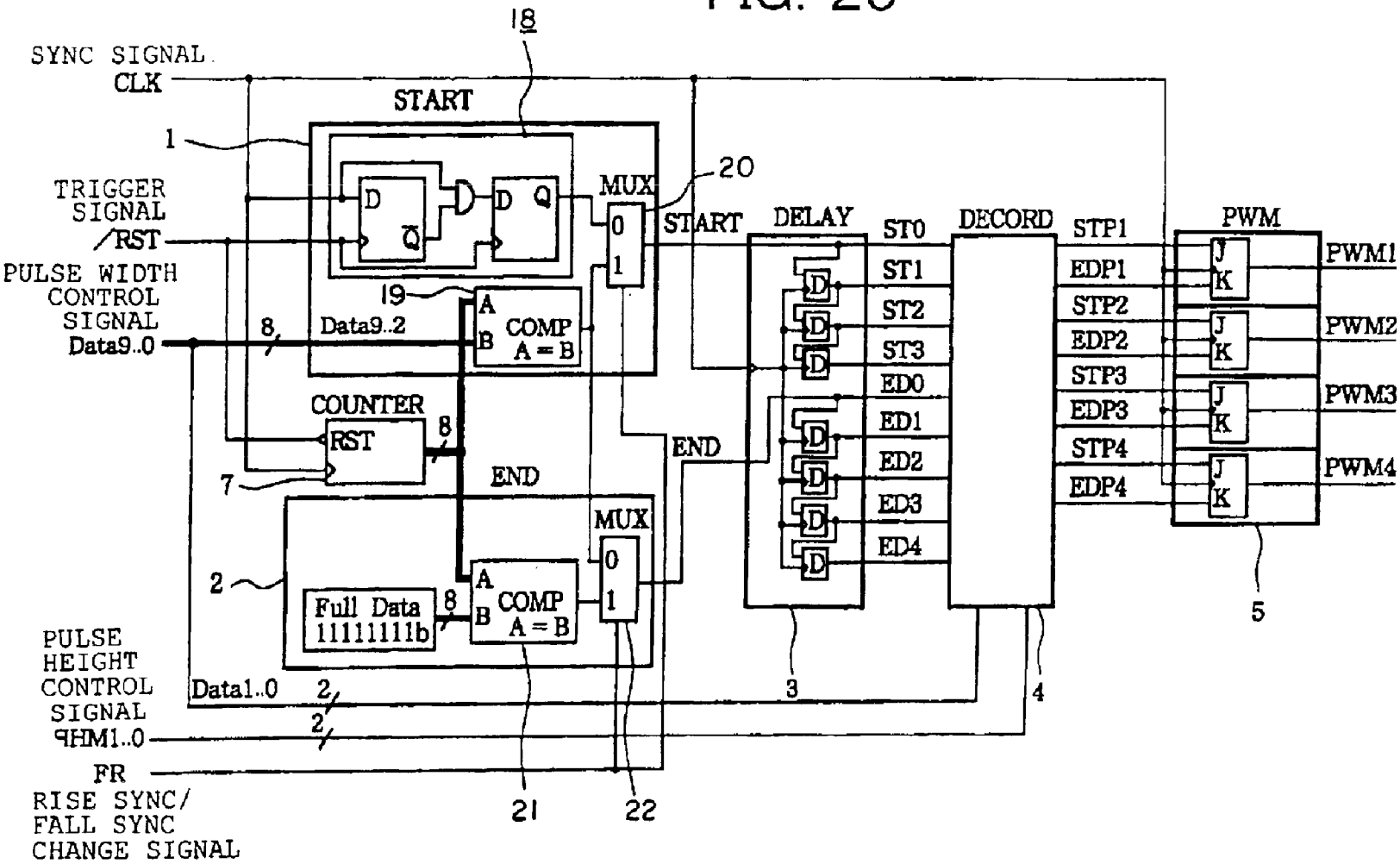
FIG. 25 is a circuit diagram showing a modification of the circuit shown in FIG. 15.

FIG. 20 shows a timing chart when fall synchronization is performed in the circuit shown in FIG. 15. Referring to FIG. 15, the upper 8-bit data Data9 . . 2 in pulse width control signal Data9 . . 0 input to the counter 7 in the case of fall synchronization is data complement to that in the case of rise synchronization. Data9 . . 0 input to the counter 7 in this case is Data9 . . 0=1111100000b (24th gradation in the case of fall synchronization) obtained by replacing the upper 8-bit data Data9 . . 2=00000111b of the pulse width control signal in the case of rise synchronization shown in FIG. 16 with a complement 11111000b to the same (obtained by inverting 0 and 1 for each bit). FIG. 21 is a timing chart when Data9 . . 0=1111100001b (25th gradation in the case of fall synchronization) corresponding to Data9 . . 2 which is a complement to that in the case of rise synchronization. FIG. 22 is a timing chart when Data9 . . 0=1111100010b (26th gradation in the case of fall synchronization) corresponding to Data9 . . 2 which is a complement to that in the case of rise synchronization. FIG. 23 is a timing chart when Data9 . . 0=1111100011b (27th gradation in the case of fall synchronization) corresponding to Data9 . . 2 which is a complement to that in the case of rise synchronization.

The functions of the circuit shown in FIG. 15 will be described first with reference to the timing chart of FIG. 20 when Data9 . . 0=1111100000b. The counter 7 is reset by signal CLK and signal /RST input to the counter 7, starts counting from 0, and outputs a count value ("Counter" in FIG. 20) in synchronization with signal CLK. In the start pulse generation circuit 1, the comparator 19 compares the count value of the counter 7 and the value of the upper 8-bit data Data9 . . 2 in Data9 . . 0, and outputs the pulse having the length 1CLK when these values becomes equal to each other. The selecting circuit 20 selects this pulse and outputs as start pulse START. In the end pulse generation circuit 2, the comparator 21 compares the count value of the counter 7 and the value of the full data=11111111b selected by the selecting circuit 22, and generates end pulse END when these values becomes equal to each other. The value of Data9 . . 2 at this time corresponds to the number of slots (the count value of the counter 7) form the time at which the trigger signal /RST is input to the time at which the start pulse is generated.

Thereafter, when START signal generated in the start pulse generation circuit 1 and END signal generated in the end pulse generation circuit 2 are input to the delay circuit 3, signals ST0 to ST3 and ED0 to ED4 synchronized with signal CLK are output from the delay circuit 3.

Further, from signals ST0 to ST3 and ED0 to ED4 input to the decoding circuit 4, and signal Data1 . . 0 (=00b) and signal PHM1 . . 0 (=11b), STP1 to STP4 and EDP1 to EDP4 are obtained and input to the JK-FFs in the PWM generation circuit 5, and PWM output waveforms PWML to PWM4 for each of the drive signal potentials are output from the PWM generation circuit 5.

In comparison with the state shown in FIG. 20, the state shown in FIG. 21 when Data9 . . 0=111110001b is such that signal EDP1 shown in FIG. 21 is 1CLK delayed relative to that in the state shown in FIG. 20 when Data9 . . 0=1111100000b, and signal PWM1 is extended by 1CLK.

In the state shown in FIG. 22 when Data9 . . 0=1111100010b, signal EDP2 is also delayed by 1CLK, and signal PWM2 is extended by 1CLK. Signal PWM1 is the same as that shown in FIG. 21.

In the state shown in FIG. 23 when Data9 . . 0=1111100011b, signal EDP3 is also delayed by 1CLK, and signal PWM3 is extended by 1CLK. Signals PWM1 and PWM2 are the same as those shown in FIG. 22.

Thus, gradation waveforms in the case of fall synchronization shown in FIG. 14 can be formed by the circuit shown in FIG. 15.

However, the present invention is not limited to the circuit shown in FIG. 15. The PWM circuit 5 may be constituted by RS-FFs, and the decoding circuit 4 may be formed of a different circuit. The end pulse generation circuit 2 may be modified to select one of the outputs from the comparator 21 and the comparator 19 instead of switching the B input of the comparator 21.

In the circuit arrangement shown in FIG. 13, the counter circuit 7 and the comparator sections of the start pulse generation circuit 1 and the end pulse generation circuit 2, which are liable to become larger in scale, can be made compact by forming the delay circuit in the block 3, forming the decoding circuit in the block 4, and setting modes of input data in a complementary relationship in correspondence with rising and falling of the signal, in particular.

In a case where a plurality of the above-described circuits are arranged parallel to each other to obtain a plurality of drive signals, signals different from each other may be input as rise sync/fall sync change signals to each adjacent pair of the circuits or the rise sync/fall sync change signals may be changed block to block to disperse the output between rising and falling states, thereby presenting superimposition of output waveforms with respect to time. Thus, the influence of the voltage drop when the potential V4 is supplied to each circuit can be dispersed even when signals for the same gradation are input to all the circuits. That is, the circuit of this example can be used sufficiently practically also by being formed in a parallel multiple-array configuration.

As described in the first embodiment, the cold-cathode electron-emitting device used as a load driven by the above-described drive signal generation circuit in this embodiment of the present invention has a characteristic such as shown in FIG. 9. If a cold-cathode electron-emitting device of such a characteristic is used, gradations can be expressed by using the drive signal waveform shown in FIG. 2 or 14.

The embodiments of the present invention have been described with respect to drive of the cold-cathode electron-emitting device selected as a light-emitting device. However, the circuit arrangement of each of the above-described embodiments can also be used to drive any other light-emitting device or semiconductor device if the device is capable of gradation expression using the drive signal waveform shown in FIG. 2 or 14.

As the output circuit 6 shown in FIG. 15, the same output circuit as that of the first embodiment shown in FIG. 10 may be used.

The above-described drive signal generation circuit of this embodiment can also be used in the image display apparatus shown in FIG. 12 and described as an display apparatus in accordance with the first embodiment.

According to the present invention described above with respect to concrete examples thereof, a simple and low-cost circuit can be used to realize a drive signal waveform which rises and/or falls in a stepping manner. Also, a parallel multiple-array circuit can be realized in which currents are dispersed with respect to time to prevent concentration of currents.

What is claimed is:

1. A drive signal generation circuit which performs gradation control on a load by a drive signal having a stepped waveform, the drive signal being obtained by performing wave height-value modulation and pulse width modulation in combination using a multistage potential source ($V(n-1) < Vn$) having a potential range from V1 to Vn (n: an integer equal to or larger than 2), and in which if the wave height value corresponding to input gradation data is Vm ($2 \leqq m \leqq n$; m: an integer), the drive signal is caused to rise in such a manner that each output Vk ($2 \leqq k \leqq m$; k: an integer) is produced one slot after the output V(k−1) to increase the wave height value from off level to Vm in a stepping manner, one slot corresponding to a unit time of the pulse width modulation, and the drive signal is caused to fall in such a manner that each output V(k−1) ($1 \leqq k \leqq m-1$) is produced one or two slots after the output Vk to reduce the wave height value from Vm to off level in a stepping manner, said drive signal generation circuit comprising:

a start pulse output circuit for generating a pulse with which a start of the output V1 is synchronized;

an end pulse output circuit which outputs a pulse with which an end of the output Vm is synchronized;

a first delay circuit which produces a plurality of delayed outputs by successively delaying one slot at a time the pulse with which the start of the output V1 is synchronized;

a second delay circuit which produces a plurality of delayed outputs by successively delaying in one-slot steps the pulse with which the end of the output Vm is synchronized;

a circuit which generates the pulse with which the start of the output V1 is synchronized, the pulse with which the end of the output Vm is synchronized, and a control signal for setting the pulse width of each output Vk ($1 \leqq k \leqq n$) from the delayed outputs; and a pulse width generation circuit which produces a pulse width signal of each output Vk ($1 \leqq k \leqq n$) by the control signal.

2. A drive signal generation circuit according to claim 1, wherein said signal generation circuit is supplied with a synchronization clock signal for setting the time width of the slot, a start trigger signal for setting the start of the drive signal, and control data formed on the basis of the gradation data, the control data including first data signal for setting the wave height value of the drive signal, and a second data signal for setting the pulse width of the wave height value, and a third data signal for setting the stepped shape of a falling portion of the drive signal;

at least said start pulse output circuit, said end pulse output circuit, and said first and second delay circuits are controlled by the synchronization clock signal;

said start pulse output circuit is controlled by the start trigger signal;

said end pulse output circuit is controlled by the start trigger signal and the second data signal; and said circuit which produces the control signal is controlled by the third data signal and the first data signal.

3. A drive signal generation circuit according to claim 2, wherein said start pulse output circuit produces the start pulse in synchronization with the synchronization clock signal on the basis of the start trigger signal;

said end pulse output circuit has a counter which is reset by the start trigger signal, and which counts the synchronization clock signal, and a comparator which generates the end pulse when a count value of said counter and the second data signal coincide with each other;

said first delay circuit produces (n−1) number of delayed outputs by delaying the start pulse by (j−1) slots with respect to each j in $2 \leqq j \leqq n$ (j: integer);

said second delay circuit produces n number of delayed outputs by delaying the end pulse by j slots with respect to each j in $1 \leqq j \leqq n$;

said circuit which outputs the control signal selects the start pulse or one of the plurality of delayed outputs obtained by delaying the start pulse, and the end pulse or one of the plurality of delayed outputs obtained by delaying the end pulse, on the basis of the first and third data signals with respect to each output Vk, and outputs the selected pulses as an output start pulse and an output end pulse of the output Vk; and said pulse width generation circuit outputs, as the pulse width signal of each output Vk, a signal which is turned on by being timed to the output start pulse of the output Vk and is turned off by being timed to the output end pulse of the output Vk.

4. A drive signal generation circuit according to claim 1, wherein a plurality of said signal generation circuits are used by being combined in parallel with each other to respectively perform gradation control on loads connected in parallel with each other;

said start pulse output circuit selects one of a first timing in the first half of the pulse width control period, and a third timing preceding a second timing in the second half of the pulse width control period by at least a period of time corresponding to the pulse width of the output Vm to generate a pulse with which the start of the output V1 is synchronized; and said end pulse output circuit selects one of a fourth timing coming after the first timing with at least a period of time corresponding to the pulse width of the output Vm, and the second timing to generate a pulse with which the end of the output Vm is synchronized.

5. A drive signal generation circuit according to claim 4, wherein said signal generation circuit is supplied with a synchronization clock signal for setting the time width of the slot, a start trigger signal for setting the start of the drive signal, and control data formed on the basis of the gradation data, the control data including first data signal for setting the wave height value of the drive signal, and second data signal for setting the pulse width of the wave height value, and third data signal for setting the stepped shape of a falling portion of the drive signal, and a rise sync/fall sync change signal;

said drive signal generation circuit further comprises a counter which is reset by the start trigger signal, and which counts the synchronization clock signal;

at least said start pulse output circuit, said end pulse output circuit, and said first and second delay circuits are controlled by the synchronization clock signal;

said start pulse output circuit is controlled by the start trigger signal, an output from said counter, and the rise sync/fall sync change signal;

said end pulse output circuit is controlled by the start trigger signal, the second data signal, the output from said counter, and the rise sync/fall sync change signal;

said circuit which produces the control signal is controlled by the third data signal and the first data signal; and the second data signal for fall synchronization is set as the difference between data for setting the limit position of the trailing end of the output Vm and the second data signal for rise synchronization.

6. A drive signal generation circuit according to claim 5, wherein said start pulse output circuit includes a circuit which generates a first pulse in synchronization with the synchronization clock signal on the basis of the start trigger signal, a comparator which generates a second pulse when the count value of said counter and the second data signal coincide with each other, and a first selecting circuit which selects one of the first and second pulses on the basis of the rise sync/fall sync change signal and outputs the selected pulse as a start pulse;

said end pulse output circuit has a second selecting circuit which selects one of the second data and the limit position setting data on the basis of the rise sync/fall sync change signal, and a comparator which generates the end pulse when data output from said second selecting circuit and the count value of said counter coincide with each other;

said first delay circuit produces (n−1) number of delayed outputs by delaying the start pulse by (j−1) slots with respect to each j in $2 \leqq j \leqq n$ (j: integer);

said second delay circuit produces n number of delayed outputs by delaying the end pulse by j slots with respect to each j in $1 \leqq j \leqq n$;

said circuit which outputs the control signal selects the start pulse or one of the plurality of delayed outputs obtained by delaying the start pulse, and the end pulse or one of the plurality of delayed outputs obtained by delaying the end pulse, on the basis of the first and third data with respect to each output Vk, and outputs the selected pulses as an output start pulse and an output end pulse of the output Vk; and said pulse width generation circuit outputs, as the pulse width signal of each output Vk, a signal which is turned on by being timed to the output start pulse of each output Vk and is turned off by being timed to each output end pulse of the output Vk.

7. A drive signal generation circuit according to claim 1 or 4, further comprising an output circuit which produces an output of each wave height value, and which produces only the output having the maximum wave height value when on signals are simultaneously generated with respect to two or more outputs Vk.

8. A drive signal generation circuit according to claim 1 or 4, wherein the load is a light-emitting device.

9. A drive signal generation circuit which generates a drive signal for gradation control on a light-emitting device, the drive signal having a waveform formed by selecting a signal level from a plurality of n wave height values corresponding to different light-emitting states, said drive signal generation circuit comprising:

a circuit A which outputs a raise signal with which a rise in the waveform of the drive signal is synchronized;

a circuit B which outputs at least (n−1) number of delayed signals with an incremental delay of a predetermined time period from the raise signal; and a circuit C which outputs the drive signal having a rising shape formed in the waveform of the drive signal in such a manner that the signal level is raised in synchronization with the raise signal from a signal level corresponding to an off state of the light-emitting device to the lowest of the n wave height values, and is thereafter increased to the higher wave height value one step at a time in synchronization with the delayed signals with the delay of the predetermined time period until a predetermined wave height value determined by input gradation data is reached.

10. A drive signal generation circuit according to claim 9, further comprising:

a circuit D that outputs a fall-causing signal with which a fall of the drive signal waveform from the predetermined wave height value is synchronized; and a circuit E which outputs at least n number of delayed fall signals with an incremental delay of a predetermined time period from the fall-causing signal, wherein the circuit C causes the signal level to fall to the wave height value one step lower than the predetermined wave height value in synchronization with the fall-causing signal, and thereafter causes the signal level to fall to the lower wave height values one step at a time in synchronization with the delayed fall-causing signals selected according to the input gradation data.

11. A drive signal generation circuit according to claim 10, wherein said circuit A outputs the raise signal by a timing based on a trigger signal and raise position data externally supplied.

12. A drive signal generation circuit according to any one of claim 10, wherein the predetermined wave height value is the mth wave height value from the lowest of the n number of wave height values ($m \leqq n$), and the selection of the delayed fall-causing signals is made from the (m−1) number among the n number of delayed fall-causing signals.

13. A drive signal generation circuit according to claim 9, wherein said circuit A outputs the raise signal by a timing based on a trigger signal and raise position data externally supplied.

14. A drive signal generation circuit according to claim 13, further comprising:

a circuit D which outputs a fall-causing signal according to a timing based on the trigger signal and fall position data externally supplied along with the trigger signal, a fall of the drive signal waveform from the predetermined wave height value being synchronized with the fall-causing signal; and a circuit E which outputs at least n number of delayed fall-causing signals with an incremental delay of a predetermined time period from the fall-causing signal, wherein the circuit C causes the signal level to fall to the wave height value one step lower than the predetermined wave height value in synchronization with the fall-causing signal, and thereafter causes the signal level to fall to the lower wave height values one step at a time in synchronization with the delayed fall-causing signals selected according to the input gradation data.

15. An image display apparatus comprising a plurality of light-emitting devices and a drive signal generation circuit according to any one of claim 9, the drive signal generation circuit generating drive signals for driving the plurality of light-emitting devices.

16. An image display apparatus according to claim 15, wherein said plurality of light-emitting devices are connected in a matrix configuration by a plurality of scanning wirings and a plurality of modulation wirings, and a plurality of said drive signal generation circuits are respectively connected to the modulation wirings.

17. An image display apparatus according to claim 16, further comprising a scanning circuit, wherein said scanning circuit selects said plurality of scanning wirings one after another and applies a selecting potential to the selected scanning wiring, and wherein said plurality of drive signal generation circuits supplies the drive signals for driving to the plurality of light-emitting devices connected to each of the plurality of scanning wirings in a time period during which the scanning wiring is selected.

18. A drive signal generation circuit which generates a drive signal for gradation control on a light-emitting device, the drive signal having a waveform formed by selecting a signal level from a plurality of n wave height values corresponding to different light-emitting states, said drive signal generation circuit comprising:

a circuit D which outputs a fall-causing signal with which a fall in signal level from a predetermined wave height value to a wave height value one step lower is synchronized;

a circuit E which outputs at least n number of delayed fall-causing signals with an incremental delay of a predetermined time period from the fall-causing signal; and a circuit C which causes the signal level to fall to the wave height value one step lower than the predetermined wave height value in synchronization with the fall-causing signal, and thereafter causes the signal level to fall to the lower wave height values one step at a time in synchronization with the delayed fall-causing signals selected according to the input gradation data.

19. A drive signal generation circuit according to claim 18, wherein said circuit D outputs the fall-causing signal by a timing based on a trigger signal and fall-causing position data externally supplied.

20. A drive signal generation circuit according to any one of claim 18, wherein the predetermined wave height value is the mth wave height value from the lowest of the n number of wave height values ($m \leqq n$), and the selection of the delayed fall-causing signals is made from the (m−1) number among the n number of delayed fall-causing signals.

21. An image display apparatus comprising:

a plurality of scanning wirings and a plurality of modulation wirings connected in a matrix configuration;

light-emitting devices provided in correspondence with points of intersection of said scanning wirings and said modulation wirings; and a drive signal generation circuit which generates a drive signal for performing gradation control on each of said light-emitting devices according in an input luminance signal, wherein the drive signal is obtained by modulation which is a combination of wave height-value modulation and pulse width modulation, and has a waveform in which the wave height value is successively increased in a stepping manner from a rise start point determined by a gradation value in a luminance signal related to the drive signal, and is successively reduced in a stepping manner from a fall start point determined irrespective of the gradation value.

22. An image display apparatus comprising:

a plurality of scanning wirings and a plurality of modulation wirings connected in a matrix configuration;

light-emitting devices provided in correspondence with points of intersection of said scanning wirings and said modulation wirings; and a drive signal generation circuit which generates a drive signal for performing gradation control on each of said light-emitting devices according to an input luminance signal, wherein the drive signal is obtained by modulation which is a combination of wave height-value modulation and pulse width modulation, and wherein, in a time period during which one of said plurality of scanning wirings is selected, each of part of the plurality of drive signals for gradation control on the plurality of light-emitting devices connected to the selected one of the scanning wirings has a waveform in which the wave height value is successively increased in a stepping manner from a rise start point determined by a gradation value in a luminance signal related to the drive signal, and is successively reduced in a stepping manner from a fall start point determined irrespective of the gradation value, and each of the other drive signals has a waveform in which the wave height value is successively reduced from a fall start point determined by a gradation value in a luminance signal related to the drive signal, and is, before the start of falling, successively increased in a stepping manner from a rise start point determined irrespective of the gradation value.

23. A control method of controlling a light-emitting device by a drive signal which is wave height-value controlled with respect to a plurality of discrete wave height values, and which is pulse width controlled with respect to discrete pulse widths, said method comprising:

forming a digital video word including a plurality of subwords from gradation data;

selecting a part of a plurality of signals each having a predetermined difference in time from a predetermined timing on the basis of a part of, not the whole of, the plurality of subwords to produce a plurality of pulse width control signals in each of which a predetermined active time is specified; and controlling the pulse width of each wave height value of the drive signal according to the active time.

24. A control method according to claim 23, wherein the drive signal is controlled so that each of a rising portion and a falling portion of the waveform of the drive signal is stepped.

25. A control method according to claim 23, wherein the digital video word includes a wave height value subword indicating wave height values to be used in the plurality of wave height values, and a pulse width subword indicating the pulse width of the waveform.

26. A control method according to claim 25, wherein the digital video word includes a subword indicating the shape of an end portion of the waveform of the drive signal.

* * * * *